US007991322B2

(12) United States Patent
Ukai

(10) Patent No.: US 7,991,322 B2
(45) Date of Patent: Aug. 2, 2011

(54) IMAGE FORMING APPARATUS

(75) Inventor: Masamitsu Ukai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 316 days.

(21) Appl. No.: 12/406,987

(22) Filed: Mar. 19, 2009

(65) Prior Publication Data

US 2009/0269085 A1 Oct. 29, 2009

(30) Foreign Application Priority Data

Apr. 25, 2008 (JP) ..... 2008-115404

(51) Int. Cl.
*G03G 21/18* (2006.01)
*G03G 21/16* (2006.01)
*G03G 15/00* (2006.01)

(52) U.S. Cl. ..... 399/111; 399/9; 399/13; 399/107; 399/110; 399/167

(58) Field of Classification Search ..... 399/9, 12, 399/13, 107, 110–114, 117, 124, 167
See application file for complete search history.

(56) References Cited

U.S. PATENT DOCUMENTS 6,229,974 B1 * 5/2001 Noda ..... 399/111
7,415,224 B2 * 8/2008 Hayakawa ..... 399/111
7,526,228 B2 * 4/2009 Shiraki ..... 399/111
7,596,327 B2 * 9/2009 Kamimura ..... 399/12
2005/0214023 A1 * 9/2005 Foster et al. ..... 399/110
2006/0193646 A1 8/2006 Suzuki et al.
2007/0147852 A1 6/2007 Aratachi
2007/0147883 A1 * 6/2007 Sato et al. ..... 399/111
2008/0223173 A1 * 9/2008 Ishikawa ..... 74/640

FOREIGN PATENT DOCUMENTS

JP 2000-221781 8/2000
JP 2006-267994 10/2006
JP 2007-178611 7/2007

* cited by examiner

*Primary Examiner* — David P Porta
*Assistant Examiner* — Jessica L Eley
(74) *Attorney, Agent, or Firm* — Banner & Witcoff, Ltd

(57) ABSTRACT

An image forming apparatus is provided. In the image forming apparatus, a contact portion that contacts a detection gear of a development cartridge and to which information about the development cartridge is transmitted is positioned inside of a path for attachment and detachment of a process cartridge. At both times of attachment and detachment of the process cartridge to and from a main unit casing, when the process cartridge contacts the contact portion, the contact portion can be swayed in a single direction while a pivot extending in a direction parallel to the direction of attachment and detachment of the process cartridge is taken as a fulcrum for swaying action.

10 Claims, 11 Drawing Sheets

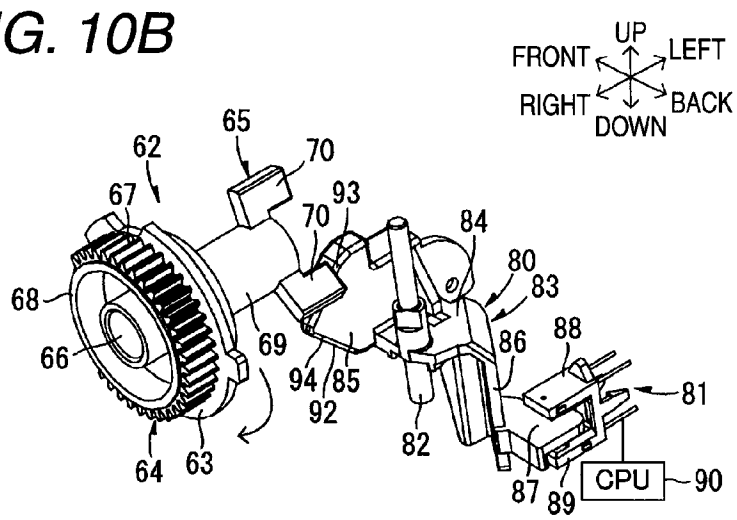
FIG. 10A
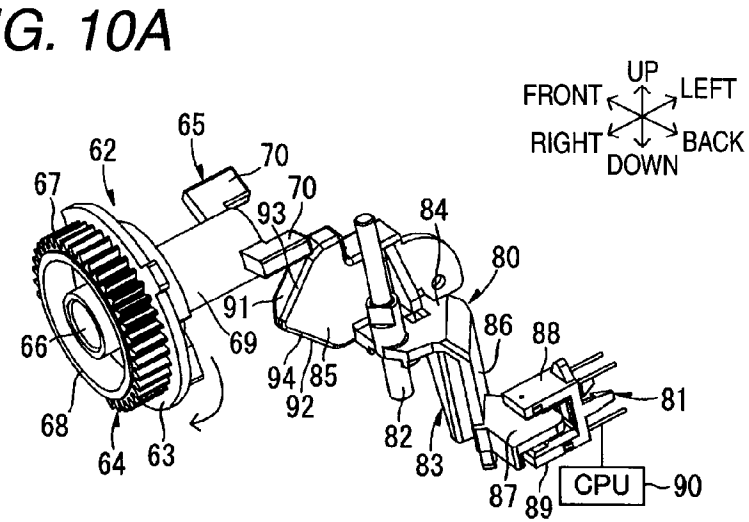
FIG. 10B
FIG. 10C
FIG. 10D

IMAGE FORMING APPARATUS

CROSS REFERENCE TO RELATED APPLICATION

The present application claims priority from Japanese Patent Application No. 2008-115404, which was filed on Apr. 25, 2008, the disclosure of which is herein incorporated by reference in its entirety.

TECHNICAL FIELD

Apparatuses and devices consistent with the present invention relate to an image forming apparatus such as an electrophotographic printer.

BACKGROUND

Japanese unexamined patent application publication No. JP-A-2006-267994 (Patent Document 1) describes a related art image forming apparatus. In the related art image forming apparatus, a process cartridge having a development cartridge is removably attached to a main unit casing. In the related art image forming apparatus, an attached process cartridge detects whether or not a development cartridge is new, thereby measuring the life of the development cartridge since when the development cartridge was determined to be new by detection.

For instance, the related art image forming apparatus has a development cartridge which includes a detection gear consisting of a cogless gear and contact projections formed on the detection gear, and has a main unit casing which includes an actuator and an optical sensor.

In the related art image forming apparatus, when the process cartridge is attached to the main unit casing, warm-up operation is started, and driving force is transmitted from a motor installed in the main unit casing to the development cartridge.

When the development cartridge is new, driving force for the cartridge is transmitted to the detection gear, the detection gear rotates. Thereupon, a contact projection comes into contact an actuator, and the actuator blocks detection light for an optical sensor.

In the meantime, when the development cartridge is old, driving force for the cartridge is not transmitted to the detection gear, and the detection gear is not rotated. Accordingly, the contact projection does not contact the actuator; hence, detection light for the optical sensor passes through the sensor.

A CPU provided in the main unit casing determines whether or not a development cartridge is new, by detection/nondetection of detection light for the optical sensor.

SUMMARY

In the related art image forming apparatus described in Patent document 1, an actuator is disposed outside a path for attachment (an attachment path) of a process cartridge to a main unit casing. Therefore, when the process cartridge is attached to or removed from the main unit casing, occurrence of interference between the process cartridge and the actuator is prevented.

In the meantime, when the apparatus is designed compact, there are cases where the actuator must be disposed inside of the attachment path of the process cartridge.

In such a case, the process cartridge interferes with the actuator at the time of removal attachment of the process cartridge. When the process cartridge has contacted the actuator, the actuator must be rotated so as to recede to a position outside the attachment path of the process cartridge.

Further, the process cartridge contacts the actuator in opposite directions at the time of attachment and removal of the process cartridge. Hence, the actuator must be rotated in response to attachment and removal of the process cartridge.

However, when an attempt is made to rotate the actuator in both directions, the configuration of the apparatus becomes complicate, which in turn raises a problem of an increase in the number of components.

The objective of the present invention is to provide an image forming apparatus which enables placement of a swaying member at a position inside of a path for attachment and detachment of a cartridge to and from an apparatus main unit by means of a simple configuration while the number of components is reduced, thereby enabling making of an attempt to miniaturize the apparatus main unit.

Accordingly, it is an aspect of the invention to provide an image forming apparatus having an apparatus main unit; a cartridge removably attached to the apparatus main unit; a drive transmission member for transmitting driving force to the cartridge; and an information transmission mechanism for transmitting information about the cartridge from the cartridge to the apparatus main unit, wherein the information transmission mechanism includes a drive member that is provided in the cartridge and that performs driving in a predetermined amount of momentum from beginning of driving operation until an end of the same as a result of driving force being transmitted from the drive transmission member when the cartridge is attached to the apparatus main unit, a swaying member that is provided in the apparatus main unit and that sways upon contact with the drive member when the drive member is driven, and a detection member that is provided in the apparatus main unit and that detects swaying action of the swaying member; and the swaying member includes a pivot extending in a direction parallel to a direction of attachment and detachment of the cartridge to and from the apparatus main unit, and a contact portion that contacts the cartridge both at times of attachment and detachment of the cartridge to and from the apparatus main unit, thereby swaying in a single direction while taking the pivot as a fulcrum.

According to the above, when the cartridge is attached to the apparatus main unit, driving force is transmitted from the drive transmission member, whereupon the drive member performs driving operation in a predetermined amount of momentum. When the drive member is driven, the swaying member contacts the drive member. The swaying member is swayed upon contact with the drive member, and swaying action is detected by the detection member. Information about the cartridge is thereby transmitted from the cartridge to the apparatus main unit.

BRIEF DESCRIPTION OF THE DRAWINGS

Illustrative aspects of the invention will be described in detail with reference to the following figures wherein:

FIGS. 10A to 10D are perspective views of a principal section for describing operation for transmitting and detecting information about the development cartridge, wherein FIG. 10A shows a state achieved before a projecting portion contacts the contact portion, FIG. 10B shows a state in which the projecting portion remains in contact with the contact portion, FIG. 10C shows a state in which a swaying lever sways while taking a pivot as a fulcrum for swaying action as a result of the projecting portion contacting the contact portion, and FIG. 10D shows a state in which a light-shielding plate recedes from an optical sensor as a result of swaying action of the swaying lever;

DETAILED DESCRIPTION OF EXEMPLARY EMBODIMENTS OF THE PRESENT INVENTION

1. Printer

Figure 1:
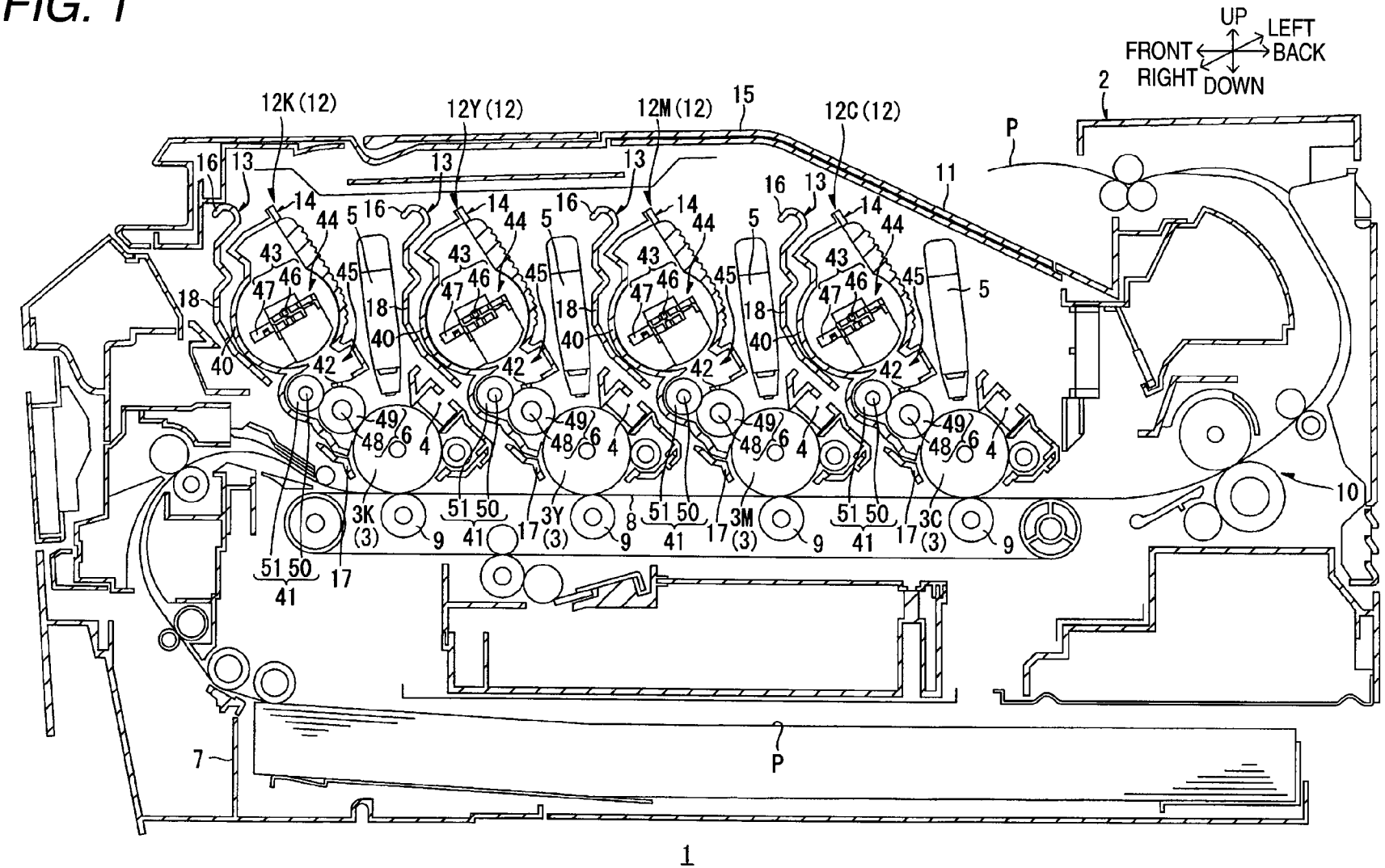
FIG. 1 is a central cross-sectional view showing an exemplary embodiment of a printer.

FIG. 1 is a center cross-sectional view showing an embodiment of a printer serving as an example of an image forming apparatus of the present invention. In the following descriptions, when a reference is made to directions, the directions shown in FIG. 1 are taken as references. The right-left direction is identical with a widthwise direction.

A printer 1 is a color LED printer of a direct tandem type. As shown in FIG. 1, four photosensitive drums 3 serving as example photosensitive elements are arranged side by side along a front-back direction within a main unit casing 2 serving as an example of an apparatus main unit of the printer 1.

Four photosensitive drums 3 are hereinbelow distinguished from each other in accordance with respective colors (black, yellow, magenta, and cyan) of toner images, as a photosensitive drum 3K (black), a photosensitive drum 3Y (yellow), a photosensitive drum 3M (magenta), and a photosensitive drum 3C (cyan).

In each of the photosensitive drums 3, a scorotoron electrifier 4, an LED unit 5, and a development roller 6 are disposed opposite to each other.

After having been uniformly electrified by the scorotoron electrifier 4, the surface of the photosensitive drum 3 is exposed to light emitted from the LED unit 5. As a result, an electrostatic latent image based on image data is generated on the surface of the photosensitive drum 3. The electrostatic latent image is visualized by toner held on the development roller 6, whereupon a toner image serving as an example of a developing-agent image is produced on the surface of the photosensitive drum 3.

Sheets P are housed in a sheet feed cassette 7 in the main unit casing 2. The sheets P housed in the sheet feed cassette 7 are fed to the conveyance belt 8 by a conveyance belt 8 by way of various rollers.

The conveyance belt 8 is positioned between the respective photosensitive drums 3K, 3Y, 3M, and 3C and transfer rollers 9 opposing to them. Toner images on surfaces of the respective photosensitive drums 3 are transferred to a sheet P conveyed by the conveyance belt 8 by means of a transfer bias applied to the transfer rollers 9, to thus be sequentially superimposed.

The sheet P on which the toner images of four colors are transferred is conveyed to a fixing section 10. The toner images transferred onto the sheet P are thermally fixed by the fixing section 10. As a result, the sheet P is output to a sheet discharge tray 11 by means of the various rollers.

2. Process Cartridge

Figure 2:
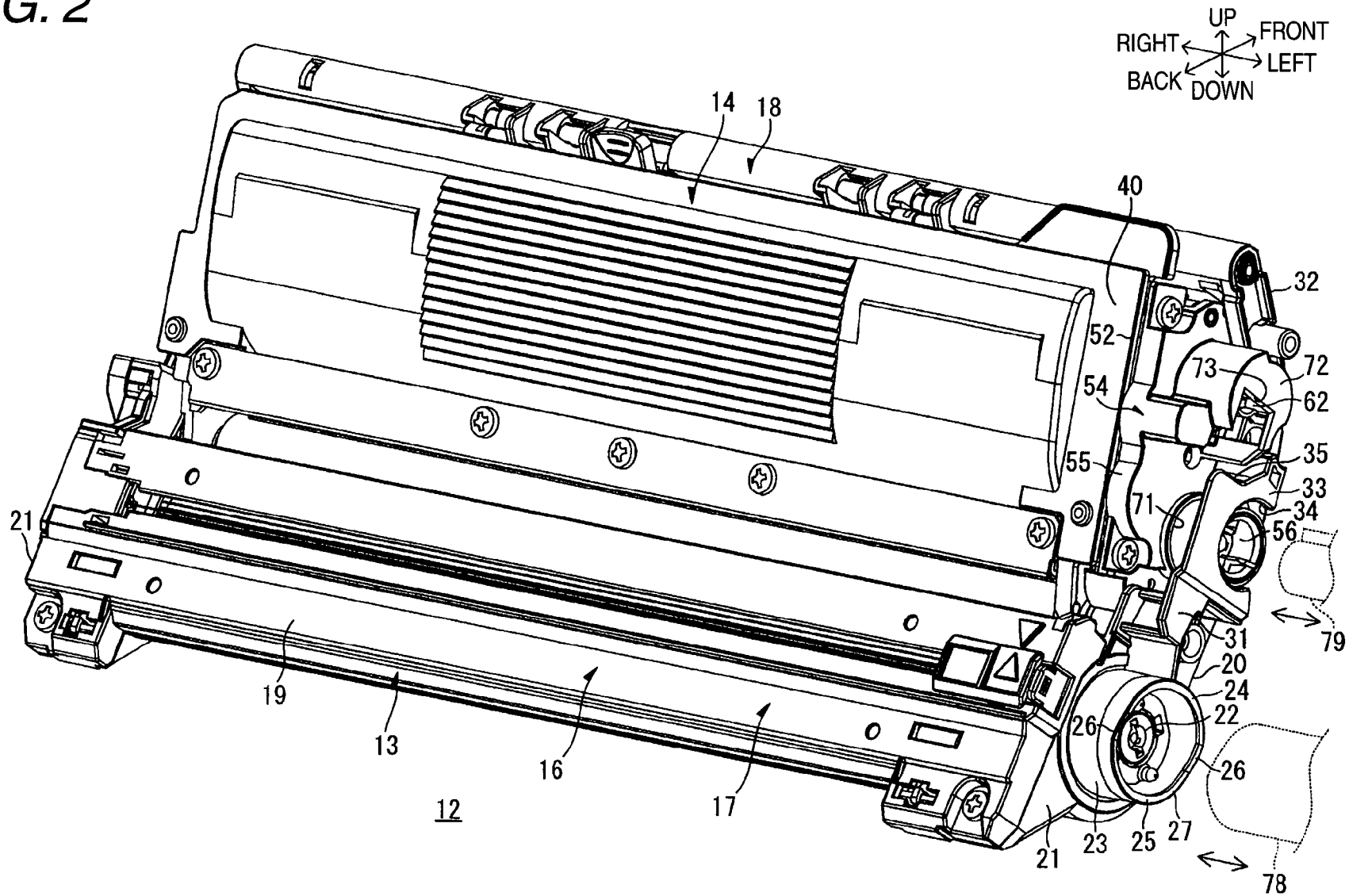
FIG. 2 is a rear left perspective view of a process cartridge.
Figure 3:
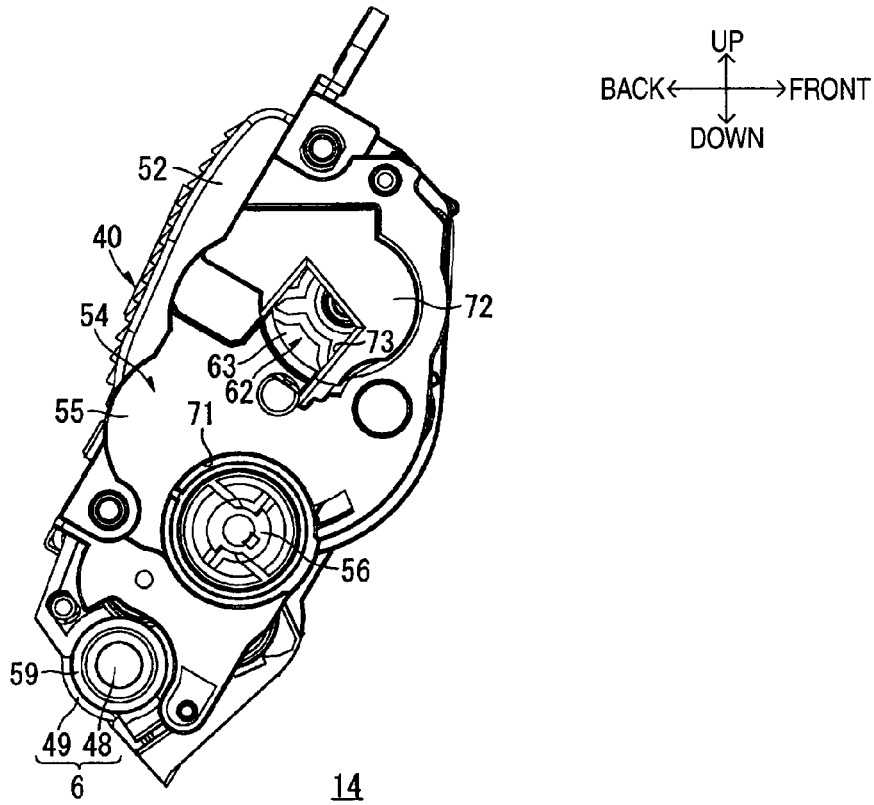
FIG. 3 is a left side view of a development cartridge (achieved when a gear cover is attached)
Figure 4:
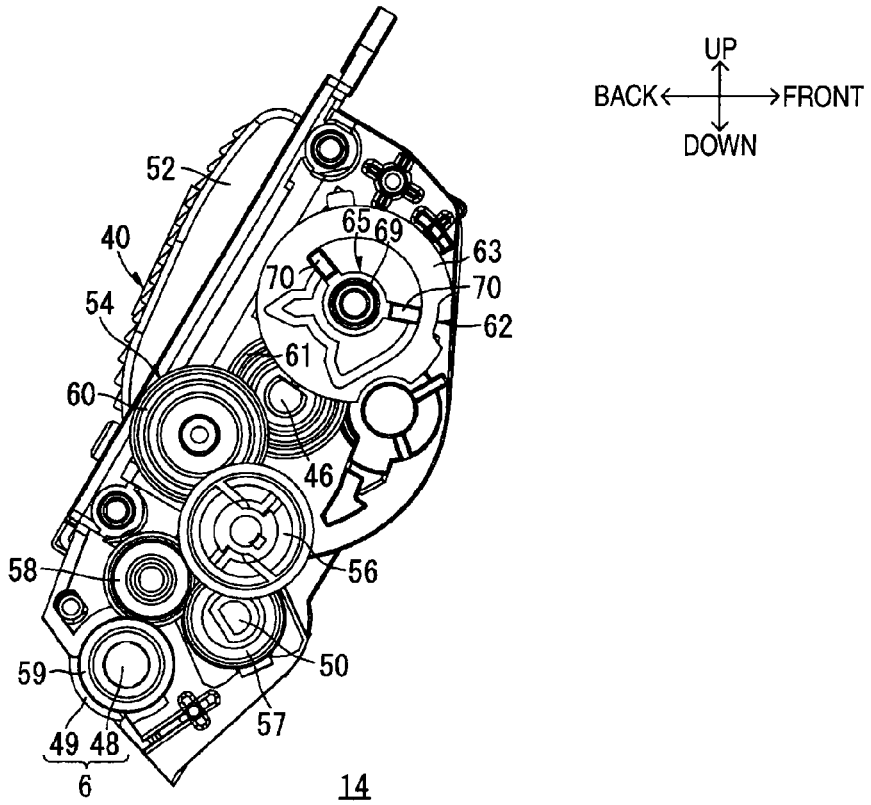
FIG. 4 is a left side view of the development cartridge (achieved when the gear cover is detached)
Figure 5:
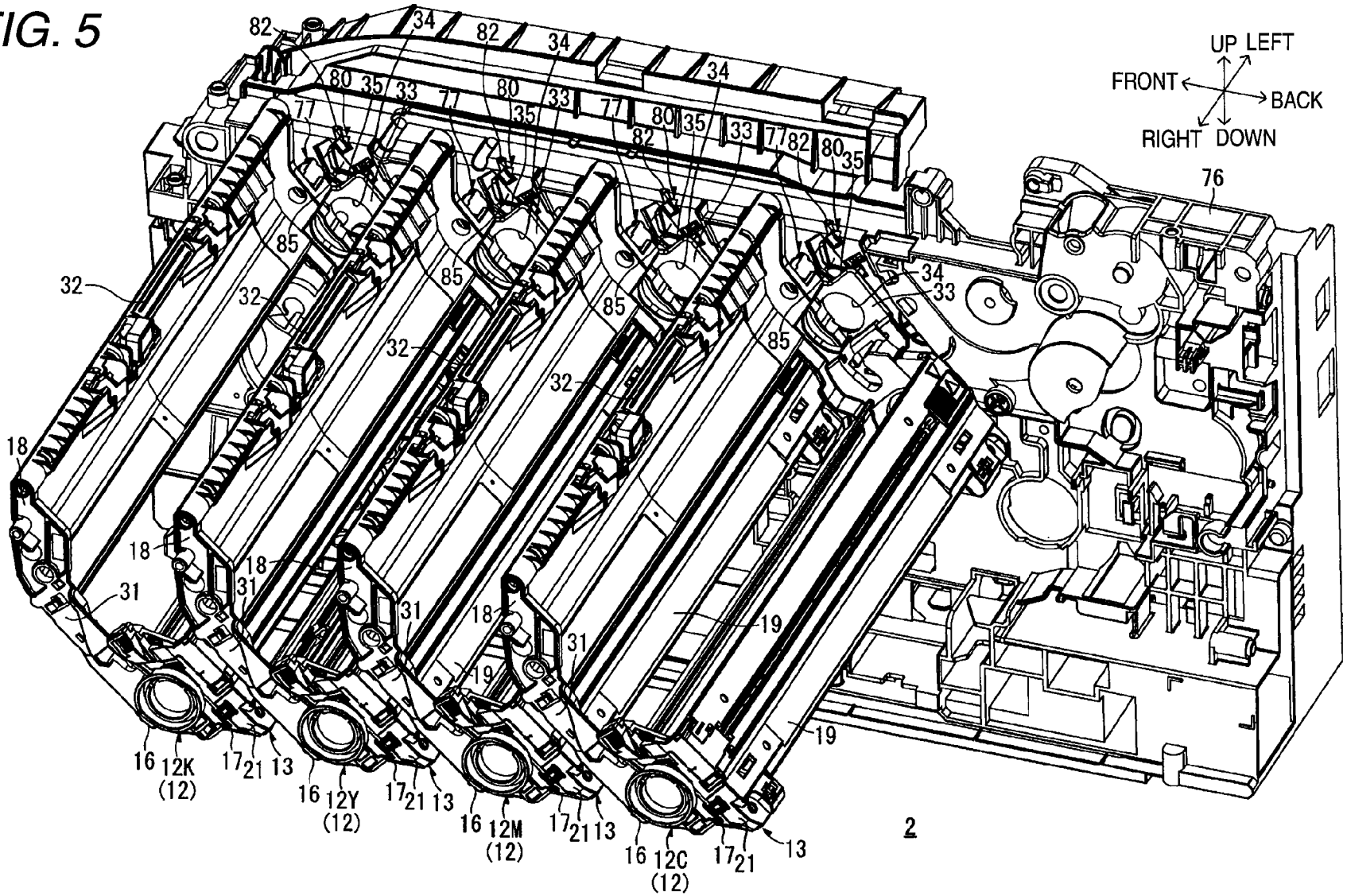
FIG. 5 is a rear right perspective view showing an interior of a main unit casing.

FIG. 2 is a rear left perspective view of the process cartridge. FIG. 3 is a left side view of the development cartridge (with a gear cover). FIG. 4 is a left side view of the development cartridge (without the gear cover). FIG. 5 is a rear right perspective view showing the inside of the main unit casing.

As shown in FIG. 1, the printer 1 has four process cartridges 12 serving as example cartridges in correspondence to respective colors. In the following descriptions, the four process cartridges 12 are distinguished from each other, in correspondence to colors, as a process cartridge 12K (black), a process cartridge 12Y (yellow), a process cartridge 12M (magenta), and a process cartridge 12C (cyan).

The respective process cartridges 12 are removably attached to the inside of the main unit casing 2 and arranged side by side along the front-back direction. Specifically, the four process cartridges 12 are sequentially arranged in the main unit casing 2 from front to back so as to attain an order of the process cartridge 12K, the process cartridge 12Y, the process cartridge 12M, and the process cartridge 12C.

A top cover 15 is reclosably provided on an upper wall of the main unit casing 2. The respective process cartridges 12 can be attached to or removed from the main unit casing 2 by opening the top cover 15.

As shown in FIGS. 1 and 2, each of the process cartridges 12 has a drum cartridge 13 and a development cartridge 14 removably attached to the drum cartridge 13.

(1) Drum Cartridge

The drum cartridge 13 has a drum frame 16, and the photosensitive drum 3 and the scorotoron electrifier 4 which are provided on the drum frame 16.

As shown in FIGS. 2 and 5, each of the drum frames 16 integrally has a drum support section 17 disposed at a lower rear position and a development cartridge housing section 18 disposed at an upper front position.

(1-1) Drum Support Section

The drum support section 17 assumes a substantially-box-shaped form that extends in a widthwise direction and that is opened along a direction from a lower rear position to an upper front position; and has a ceiling wall 19, a bottom wall 20 spaced apart from the ceiling wall 19, and side walls 21 that link up respective widthwise ends of the ceiling wall 19 and the bottom wall 20.

Each of the photosensitive drums 3 is positioned in its widthwise direction between the ceiling wall 19 and the bottom wall 20 and rotatably supported by the side walls 21 (see FIG. 1).

As shown in FIG. 2, a drum-side input coupling 22 serving as an example of a photosensitive element drive member for driving the photosensitive drum 3 is provided on the left side wall 21.

The drum-side input coupling 22 is disposed opposite the left end of the photosensitive drum 3 and joined to the photosensitive drum 3 so as to be relatively nonrotatable. The drum-side input coupling 22 is provided so as to leftwardly protrude from the left side wall 21.

A coupling cover 23 serving as an example of a protective member for protecting the drum-side input coupling 22 is provided on the left side wall 21.

The coupling cover 23 assumes a substantially-cylindrical shape and is provided so as to surround the drum-side input coupling 22 and protrude leftwards from the left side wall 21.

The coupling cover 23 is made in such a way that an upper front end face of the cover (hereinafter called an "upper front cover end face 24") protrudes leftwards than does a rear lower end face (hereinafter called a "lower rear cover end face 25"). When viewed in the left, the upper front cover end face 24 is formed into a substantially-U-shaped form whose lower rear side is opened. When viewed in the left, the lower rear cover end face 25 is formed into a substantially-U-shaped form whose upper front side is opened.

Sloped cover end faces 26 sloped rightwards with an increasing distance from an upper front position to a lower rear position are provided between the upper forward cover end face 24 and the lower rear cover end face 25. The sloped cover end faces 26 are separated from each other with the drum-side input coupling 22 sandwiched therebetween. Of the sloped cover end faces 26, a lower front sloped cover end face 26 and an upper rear sloped cover end face 26 link both ends of the upper front cover end face 24 and both ends of the lower rear cover end face 25, respectively.

A semicircular-arc outer circumference 27 defined by a lower front half of the lower rear cover end face 25, the lower front sloped cover end face 26, and a lower front half of the upper front cover end face 24 is an example of a third contact portion that contacts a contact portion 85 to be described later (see FIGS. 6 through 9). The outer circumference 27 defined by a lower front half of the sloped cover end face 26 is sloped so as to extend from a lower rear position to an upper front position in a circular-arc curve. The outer circumference 27 defined by the lower front sloped cover end face 26 and the lower front half of the upper front cover end face 24 is sloped so as to extend from a lower rear position to an upper front position in a circular-arc curve.

Each of the scorotoron electrifiers 4 extends in its widthwise direction and is supported by the ceiling wall 19.

(1-2) Development Cartridge Housing Section

As shown in FIGS. 2 and 5, each of the development cartridge housing sections 18 has, in such a way that the development cartridge 14 is removably attached, side walls 31 spaced apart from each other in the widthwise direction so as to mutually oppose each other and an upper front wall 32 extended along upper front ends of both side walls 31.

Both side walls 31 of the development cartridge housing sections 18 are made so as to become continual to the side walls 21 of each of the drum support sections 17.

A coupling insertion plate 33, which is placed at a further leftward position than the side wall 31, is provided for each of the left side walls 31. The coupling insertion plate 33 is formed so as to become continual to the left side wall 31 and assume, at a much leftward position with reference to the left side wall 31, a substantially-rectangular shape extending in parallel to the left side wall 31. The coupling insertion plate 33 is placed opposite to the development-side input coupling 56 (which will be described later) in its widthwise direction.

A lower front section of the coupling insertion plate 33 is made so as to become larger than its upper rear section, and an opening section 34 that is substantially circular when viewed sideways is formed in the lower front section so as to enable insertion of a development-side output coupling 79.

An upper edge 35 of the upper rear section of the coupling insertion plate 33 is an example of a fourth contact portion that contacts the contact portion 85 to be described later, and is sloped from an upper rear position toward a lower front position.

The upper front wall 32 is provided between the side walls 31 so as to assume a curve along upper front ends of the side walls 31.

(2) Development Cartridge

Each of the development cartridges 14 has a housing 40 provided with the development roller 6, a supply roller 41, a layer thickness regulation blade 42, and an agitator 43 (see FIG. 1).

(2-1) Housing

The housing 40 is formed in a box shape whose lower rear side is opened. As shown in FIG. 1, an upper front space of the housing 40 is defined as a toner housing chamber 44 for housing toner, and a lower rear space of the same is defined as a development chamber 45 where the development roller 6 is disposed.

The toner housing chamber 44 is filled with toner, and the agitator 43 is rotatably provided in the toner housing chamber. The agitator 43 has an agitator shaft 46 and a stirring blade 47 radially extending from the agitator shaft 46. Both ends of the agitator shaft 46 are rotatably supported by side walls 52 (see FIG. 2) of the housing 40, whereby the agitator 43 is rotatably supported by the housing 40.

Each of the development chambers 45 is provided with the development roller 6, the supply roller 41, and the layer thickness regulation blade 42.

The development roller 6 is disposed at a lower rear end of the housing 40 so as to become exposed through a lower rear section of the housing 40. Each of the development rollers 6 has a development roller shaft 48 and a rubber roller 49 provided around the development roller shaft 48. Both ends of the development roller shaft 48 are rotatably supported by the side walls 52 of the housing 40, whereby the development roller 6 is rotatably supported by the housing 40.

Each of the supply rollers 41 is positioned, in an opposing fashion, at an upper front position with reference to the development roller 6. The supply roller 41 has a supply roller shaft 50 and a sponge roller 51 provided around the supply roller shaft 50. Both ends of the supply roller shaft 50 are rotatably supported by the side walls 52 of the housing 40, whereby the supply roller 41 is rotatably supported by the housing 40.

A base end of the layer thickness regulation blade 42 is supported by the housing 40, and a leading end of the layer thickness regulation blade 42 is brought into pressed contact with the development roller 6 from above.

(2-2) Gear Mechanism Section

As shown in FIG. 4, the development cartridge 14 has a gear mechanism section 54 for rotating the development roller 6, the supply roller 41, and the agitator 43, and also has a gear cover 55 for covering the gear mechanism section 54 as shown in FIG. 3.

As shown in FIG. 4, the gear mechanism section 54 is provided on the left side wall 52 of the housing 40. The gear mechanism section 54 has the development-side input coupling 56, a supply roller gear 57, a first intermediate gear 58, a development roller gear 59, a second intermediate gear 60, an agitator gear 61 serving as an example of a transmission gear, and a detection gear 62 serving as an example of a drive member that makes up an information transmission mechanism.

The development-side input coupling 56 is interposed between the development roller shaft 48 and the agitator shaft 46 and rotatably supported by the left side wall 52.

The supply roller gear 57 is disposed at a position below the development-side input coupling 56 and at an axial end section of the supply roller shaft 50 so as to mesh with the development-side input coupling 56 and relatively nonrotatable.

The first intermediate gear 58 is rotatably supported by the left side wall 52 at a lower rear position with reference to the supply roller gear 57 so as to mesh with the supply roller gear 57.

The development roller gear 59 is disposed at a position below the first intermediate gear 58 and an axial end section of the development roller shaft 48 so as to mesh with the first intermediate gear 58 and be relatively nonrotatable.

In the meantime, a second intermediate gear 60 is rotatably supported by the left side wall 52 so as to mesh with the development-side input coupling 56 at an upper rear position with reference to the development-side input coupling 56.

The agitator gear 61 is provided at an upper front position with reference to the second intermediate gear 60 and at an axial end of the agitator shaft 46 so as to mesh with the second intermediate gear 60 and be relatively nonrotatable.

The detection gear 62 is arranged at an upper front position with reference to the agitator gear 61 and rotatably supported on the left side wall 52.

As shown in FIGS. 4 and 10, the detection gear 62 is integrally provided with a disc-shaped main body section 63, a cogless gear 64 provided on the right side surface of the main body section 63, and a detection section 65 projecting leftwards from the main body section 63.

A substantially-cylindrical support tube section 66 projecting rightwards from the center of the main body section 63 is provided on the main body section 63. A support shaft (not shown) projecting leftwards from the left side wall 52 is inserted into the support tube section 66 so as to be relatively rotatable. The detection gear 62 is rotatably supported by the left side wall 52.

The cogless gear 64 is formed in a substantially-cylindrical shape protruding rightwards from the main body section 63. A cogged section 67 and a cogless section 68 are defined along an outer peripheral surface of the cogless gear 64. The cogged section 67 is defined along about two-thirds of the outer periphery of the cogless gear 64, and the cogless section 68 is defined as an area not having the cogged section 67 over about one-third of the outer periphery of the cogless gear 64. The cogged section 67 meshes with the agitator gear 61, and driving force is transmitted to the cogged section 67 from the agitator gear 61. The agitator gear 61 does not mesh with the cogless section 68, and transmission of driving force from the agitator gear 61 is interrupted.

The detection section 65 has a cylindrical section 69 projecting leftwards from an axial core of the main unit section 63 and two projecting portions 70 projecting leftwards from a left end of the cylindrical section 69. The respective projecting portions 70 are formed to assume a substantially-L-shaped form that radially extends from an outer periphery of the cylindrical section 69 and subsequently protrudes leftwards. Further, the two projecting portions 70 are arranged so as to form an obtuse angle with respect to the cylindrical section 60.

When the development cartridges 14 are new, the projecting portions 70 are provided in such a way that the number of the projecting portions 70 corresponds, as information about the development cartridge 14, to information about the maximum number of sheets P on which images can be produced from toner in the toner storage chamber 44 (hereinafter called a "maximum number of images to be produced").

As shown in; for instance, FIG. 10, when two projecting portions 70 are provided, the number of projections corresponds to information that the maximum number of images to be produced is 6000 sheets. Although unillustrated, when one projecting portion 70 is provided, the number of projecting portion corresponds to information that the maximum number of images to be produced is 3,000.

Relative positions of the projecting portions 70 with reference to the tooth section 67 are set so as to be able to contact the contact portion 85 (which will be described later) in a period during which the detection gear 62 can rotate; namely, a period of time during the cogged section 67 meshes with the agitator gear 61.

In the detection gear 62, a coil spring is wound around the support tube section 66 of the main unit section 63, thereby forcing the detection gear 62 in such a way that a downstream end of the cogged section 67 in the direction of rotation meshes with the agitator gear 61. Accordingly, the cogged section 67 and the agitator gear 61 are in mesh since the development cartridge 14 was new.

As shown in FIG. 3, the gear cover 55 is provided on the left side wall 52 of the development cartridge 14 so as to cover the gear mechanism section 54. The gear cover 55 is cut such that the development roller gear 59 becomes exposed. A gear cover opening 71 for causing the development-side input coupling 56 to become exposed is formed in a lower section of the gear cover 55. A detection gear cover section 72 for covering the detection gear 62 is formed in an upper section of the gear cover 55.

The detection gear cover section 72 is formed so as to bulge leftwards in order to enable housing of the detection gear 62. A substantially-rectangular detection window 73 for causing the projecting portion 70, which moves in a circumferential direction along with rotation of the detection gear 62, to become exposed is opened in a lower rear position with reference to the detection gear cover section.

(2-3) Attachment of the Development Cartridge to the Drum Cartridge

As shown in FIG. 1, when the development cartridge 14 is attached to the development cartridge housing section 18, the development roller 6 is brought into pressed contact with the photosensitive drum 3 from an upper front position. Further, as shown in FIG. 2, the development-side input coupling 56 opposes the opening section 34 of the coupling insertion plate 33 in the widthwise direction, thereby allowing the development-side output coupling 79 to advance to or recede from the development-side input coupling 56 by way of the opening section 34.

3. Main Unit Casing

In the main unit casing 2, a pair of main unit side walls 76 (FIG. 5 shows only a left main unit side wall 76) are arranged so as to be spaced apart from each other in the widthwise direction at an interval that enables attachment of the process cartridges 12.

Guide sections 77 for guiding removal and attachment of the respective process cartridges 12 are formed in the pair of main unit side walls 76. The guide sections 77 are provided in response to the four process cartridges 12 while spaced apart from each other in the front-back direction.

Each of the guide sections 77 is made up of a rib that inwardly projects from the main unit side wall 76 in the widthwise direction so as to incline from an upper front position to a lower rear position.

Each of the process cartridges 12 is attached to the main unit casing 2 along a direction from an upper front position to a lower rear position (hereinafter called an "attachment direction") while guided by a corresponding guide section 77. Further, the process cartridge 12 is detached from the main unit casing 2 along a direction from a lower rear position to an upper forward position (hereinafter called a "detachment direction"). In the following descriptions, an attachment-detachment direction includes the attachment direction and a detachment direction.

(1) Drum-Side Output Coupling and Development-Side Output Coupling

The left main unit side wall 76 has four drum-side output couplings 78 in correspondence with the four drum-side input couplings 22 (see FIG. 2). Further, in a state of the process cartridges 12 being attached o the main unit casing 2, the respective drum-side output couplings 78 are arranged so as to oppose the respective drum-side input couplings 22 from the left.

The drum-side output coupling 78 advances rightwards toward the corresponding drum-side input coupling 22 in synchronism with closing action of the top cover 15 as indicated by an arrow in FIG. 2, to thus fit into the drum-side input coupling. Moreover, in synchronism with opening action of the top cover 15, the drum-side output coupling 78 recedes to the left from the corresponding drum-side input coupling 22.

Further, the drum-side output couplings 78 are connected to a motor disposed in the main unit casing 2, and driving force originating from the motor is transmitted to the respective drum-side output couplings 78.

The four development-side output couplings 79 serving as an example of a drive transmission member are provided on the left main unit side wall 76 in correspondence with the four development-side input couplings 56 (see FIG. 2). In a state of the process cartridges 12 being attached to the main unit casing 2, the respective development-side output couplings 79 are arranged so as to oppose from the left the respective development-side input couplings 56.

As indicated by an arrow of FIG. 2, each of the development-side output couplings 79 advances to the right toward the corresponding development-side input coupling 56 in synchronism with closing action of the top cover 15, to thus fit into the development-side input coupling by way of the opening section 34 of the coupling insertion plate 33. In synchronism with opening action of the top cover 15, the development-side output coupling 79 recedes to the left form the corresponding development-side input coupling 56.

Further, the development-side output couplings 79 are connected to a motor (not shown) disposed in the main unit casing 2, and driving force originating from the motor is transmitted to the respective development-side output couplings 79.

(2) Mechanism for Transmitting and Detecting Information about a Development Cartridge As shown in FIGS. 5 and 10, the main unit casing 2 has swaying members 80 making up an information transmission mechanism; optical sensors 81 serving as an example of a detection member making up the information transmission mechanism; and a CPU 90 serving as an example of an information determination section.

(2-1) Swaying Member

As shown in FIG. 5, the swaying members 80 are provided in number of four on the left main unit side wall 76 in correspondence with the four process cartridges 12.

In a state where the process cartridges 12 are attached to the main unit casing 2, the respective swaying members 80 are arranged so as to oppose the respective detection gears 62 from the left. As shown in FIG. 10, each of the swaying members 80 integrally has a pivot 82 and a swaying lever 83 provided on the pivot 82.

As shown in FIG. 5, the pivots 82 each assume the shape of a round bar and are arranged so as to extend along a direction parallel to the removal-attachment direction and rotatably supported on the left main unit side wall 76.

As shown in FIG. 10, each of the swaying levers 83 has a mount section 84 attached to the pivot 82; a contact portion 85 projecting from the mount section 84 toward an upper front position; and an arm section 86 extending from the mount section 84 toward a lower rear position.

The mount section 84 is made in the shape of a flat plate; arranged so as to become orthogonal to an axial direction of the pivot 82; and is attached integrally to the pivot 82.

The contact portion 85 is formed in the shape of a flat plate and positioned at an elevated position with respect to the mount section 84. A right end of the contact portion 85 projects rightwards than does the mount section 84 and is formed in a substantially-V-shaped geometry that becomes narrower in a rightward direction.

Specifically, in an ordinary state (which will be described later), the contact portions 85 are arranged along a direction parallel to the attachment-removal direction when viewed from the right. Two end faces differing from each other in terms of an angle; namely, an upper front end face 91 serving as an example of a first end face and a lower rear end face 92 serving as an example of a second end face, are formed on a right side edge of the contact portion 85 along the attachment and detachment directions.

The upper front end face 91 is made so as to protrude toward the process cartridge 12 with an increasing distance from an upstream position toward a downstream position in the attachment direction. A ridge line defining an upper rear edge of the upper front end face 91 is defined as an attachment-side contact portion 93 serving as an example of the first contact portion that is brought into contact with the outer circumference 27 of the coupling cover 23 of the process cartridge 12 at the time of attachment of the process cartridge. The attachment-side contact portion 93 is inclined so as to protrude toward the process cartridge 12 with an increasing distance from an upstream position toward a downstream position in the attachment direction.

The lower rear end face 92 is made so as to protrude toward the process cartridge 12 with an increasing distance from an upstream position toward a downstream position in the detachment direction. A ridge line defining an upper rear edge of the lower rear end face 92 is defined as an detachment-side contact portion 94 serving as an example of the second contact portion that is brought into contact with the upper edge 35 of the coupling insertion plate 33 of the process cartridge 12 at the time of detachment of the process cartridge. The detachment-side contact portion 94 is inclined so as to protrude toward the process cartridge 12 with an increasing distance from an upstream position toward a downstream position in the detachment direction.

The right end of the contact portion 85 is formed in a substantially-triangular shape defined by the upper front end face 91 and the lower rear end face 92. Specifically, the right end is formed in a substantially-obtuse triangle in which a plane extending along the upper front end face 91 forms an obtuse angle with a plane extending along the lower rear end face 92.

Each of the arm sections 86 is formed in the shape of a substantially-elongated flat plate and arranged so as to extend downwardly from a left end of the mount section 84. A substantially-rectangular light-shielding plate 87 projecting backwards is provided at a lower end of the arm section 86.

In the swaying member 80, a coil spring is wound around the pivot 82. As shown in FIG. 5, the contact portion 85 is forced at all times so as to protrude rightwards from the left main unit side wall 76. In an ordinary state, the contact portions 85 are arranged inside of a removal attachment path of the process cartridge 12 to the main unit casing 2.

(2-2) Optical Sensor

The optical sensor 81 is provided in the number of four on the left main unit side wall 76 in correspondence with the four swaying members 80. Specifically, the optical sensors 81 are mounted on a substrate (not shown) attached to a right surface of the left main unit side wall 76. As shown in FIG. 10, the optical sensors 81 are arranged so as to oppose the respective swaying members 80 from the left.

Each of the optical sensors 81 is formed substantially into the shape of the letter U when viewed in a cross section, and a bottom of the U shape is fixed to the substrate. A light-emitting element 88 and a light-receiving element 89 are disposed at respective ends of the U-shaped section so as to oppose each other at an interval.

In the optical sensor 81, when the swaying member 80 is in an ordinary state (see FIG. 10A), the light-shielding plate 87 is positioned between the light-emitting element 88 and the light-receiving element 89. Therefore, detection light emitted from the light-emitting element 88 is intercepted by the light-shielding plate 87, thereby preventing the light-receiving element 89 from receiving the light. In the meantime, when the swaying member 80 sways in such a way that the contact portion 85 moves toward a lower front position in defiance of restoration force of the coil spring (not shown) (see FIG. 10D), the light-shielding plate 87 recedes from its position between the light-emitting element 88 and the light-receiving element 89. Accordingly, the detection light emitted from the light-emitting element 88 is received by the light-receiving element 89. The optical sensor 81 thus detects swaying action of the swaying member 80.

(2-3) CPU

The CPU 90 is disposed on the main unit casing 2 and electrically connected to the respective optical sensors 81. When receipt of the detection light by the light-receiving element 89 of the optical sensor 81 is interrupted, a light shield signal from the optical sensor 81 is input. In the meantime, when the light-receiving element 89 of the optical sensor 81 receives the detection light, a light-receive signal from the optical sensor 81 is input.

In accordance with a result of detection performed by the optical sensor 81; namely, presence/absence of the light shield signal and the light-receive signal; and timings and times when the signals are input, the CPU 90 determines information about the development cartridge 14; specifically, information about whether or not the development cartridge 14 is new, and information about the maximum number of sheets on which images can be produced by the development cartridge 14 when the development cartridge 14 is new.

Figure 6:
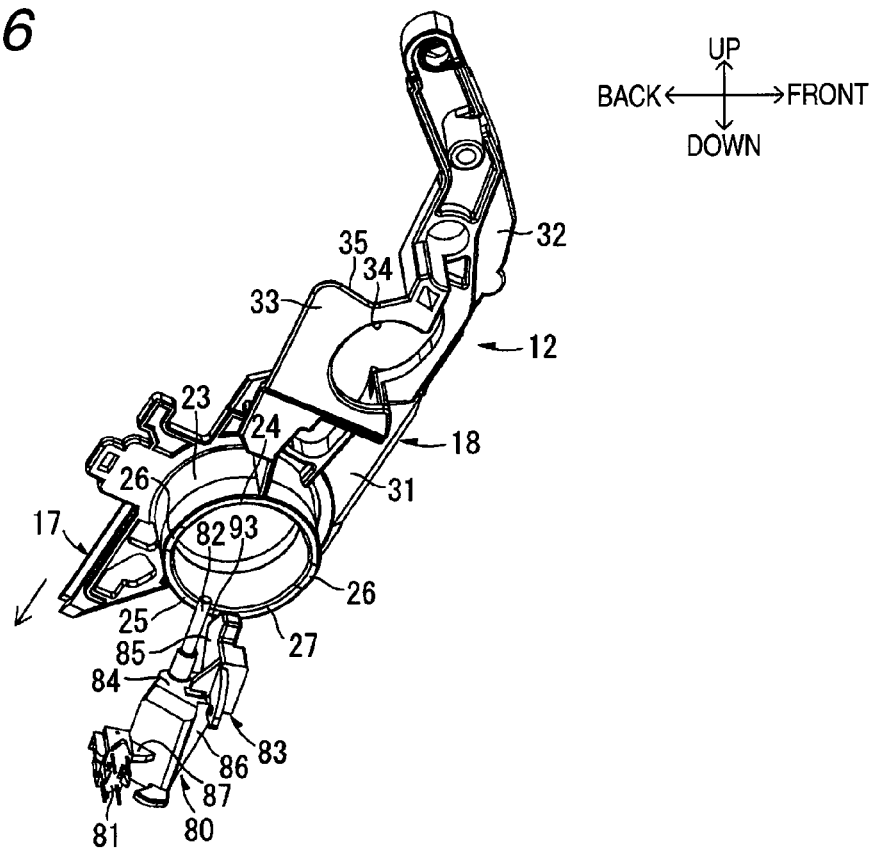
FIG. 6 is a perspective view of a principal section for describing operation for attaching the process cartridge to a main unit casing (a state in which a contact portion contacts an outer circumference defined by a rear lower end face of a cover)
Figure 7:
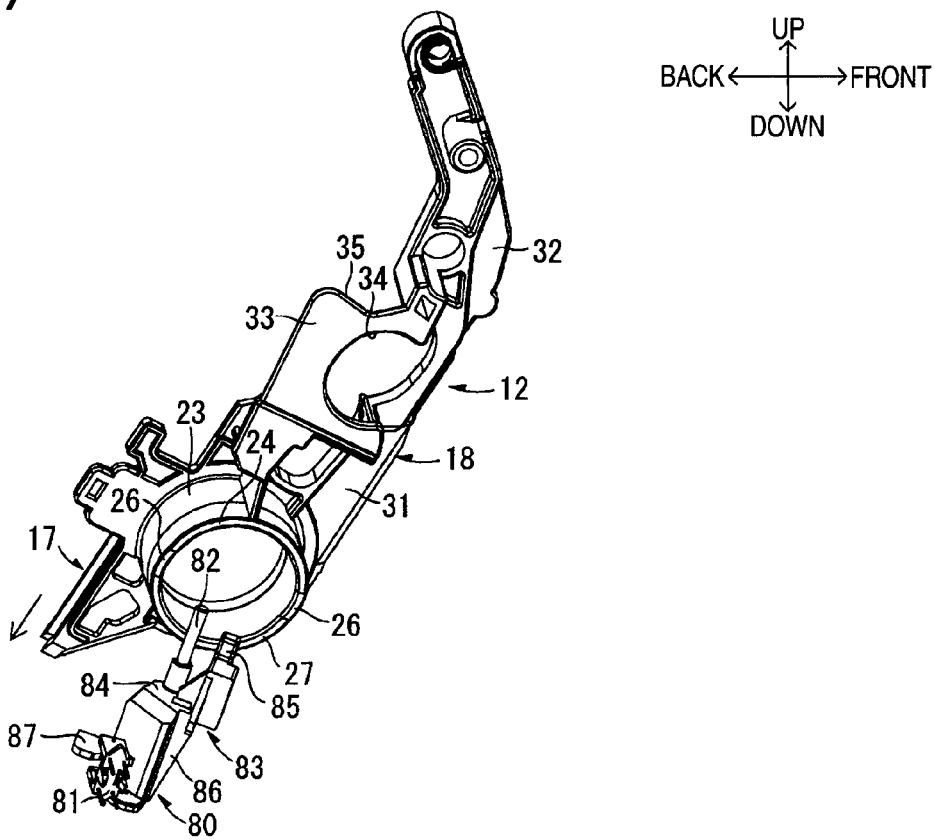
FIG. 7 is a perspective view of a principal section for describing operation for attaching the process cartridge to the main unit casing (a state in which a contact portion contacts an outer circumference defined by the rear lower end face of the cover)
Figure 8:
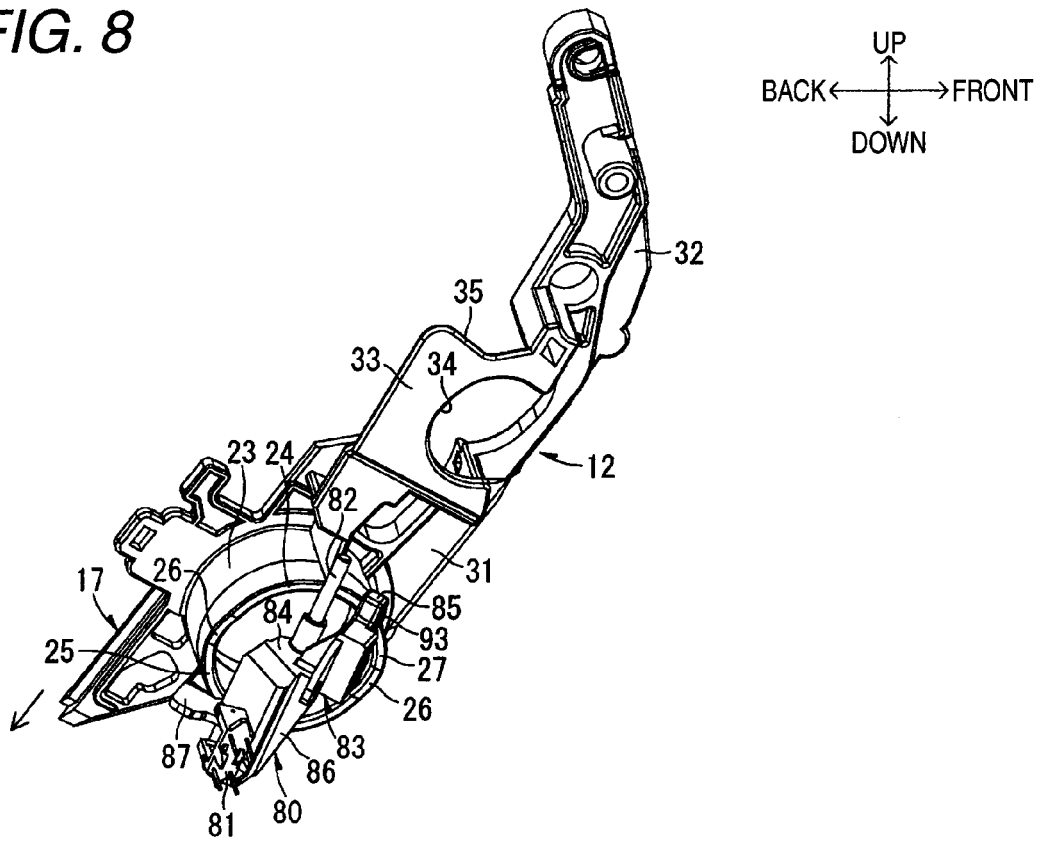
FIG. 8 is a perspective view of a principal section for describing operation for attaching the process cartridge to the main unit casing (a state in which a contact portion contacts an outer circumference defined by a front upper end face of the cover)

4. Operation for Detaching and Attaching a Process Cartridge and Operation for Detecting Information About a Development Cartridge FIGS. 6 through 8 are perspective views showing the principal sections for describing operation for attaching a process cartridge to a main unit casing. FIGS. 10A to 10D are perspective views showing the principal sections for describing operation for detecting transmission of information about a development cartridge. FIGS. 11 through 14 are perspective views showing the principal sections for describing operation for detaching the process cartridge from the main unit casing.

Operation for attaching the process cartridge 12 having a new development cartridge 14 to the main unit casing 2 and operation for detecting transmission of information about the attached process cartridge 12 will now be described.

(1) Operation for Attaching and Detaching a Process Cartridge to and from a Main Unit Casing In order to attach the process cartridge 12 to the main unit casing 2, the top cover 15 (see FIG. 1) is first opened. The drum-side output couplings 78 (see FIG. 2) and the development-side output couplings 79 (see FIG. 2) then recede leftwards in synchronism with opening action of the top cover 15.

The process cartridge 12 is attached to the main unit casing 2 along the corresponding guide section 77. In the course of attachment operation, the corresponding contact portion 85 is in an ordinary state disposed inside of the removal attachment path of the process cartridge 12 from and to the main unit casing 2. As shown in FIG. 6, the outer circumference 27 of the corresponding coupling cover 23 of the process cartridge 12 (specifically, the outer circumference 27 defined by the lower front half of the lower rear cover end face 25) contacts the attachment-side contact portion 93 of the contact portion 85.

As shown in FIG. 7, as the outer circumference 27 travels from an upstream position to a downstream position in the attachment direction, the outer circumference 27 slidably contacts the attachment-side contact portion 93, whereupon the position of the contact between the outer circumference 27 and the attachment-side contact portion 93 moves toward the upstream position in the attachment direction. Specifically, as shown in FIGS. 7 and 8, the position where the attachment-side contact portion 93 contacts the outer circumference moves from the outer circumference 27 defined by the lower rear cover end face 25 to the outer circumference 27 defined by the upper front cover end face 24 by way of the outer circumference 27 defined by the sloped cover end face 26 located at a lower front position.

The contact portion 85 then undergoes pressing force stemming from sliding movement and is swayed toward a lower front position so as to recede from the inside of the removal attachment path of the process cartridge 12 in defiance of restoration force of a coil spring (not shown) while taking the pivot 82 as a pivot. The contact portion 85 thereby recedes from the inside of the attachment and detachment path of the process cartridge 12, thereby allowing attachment of the process cartridge 12 to the main unit casing 2.

Figure 9:
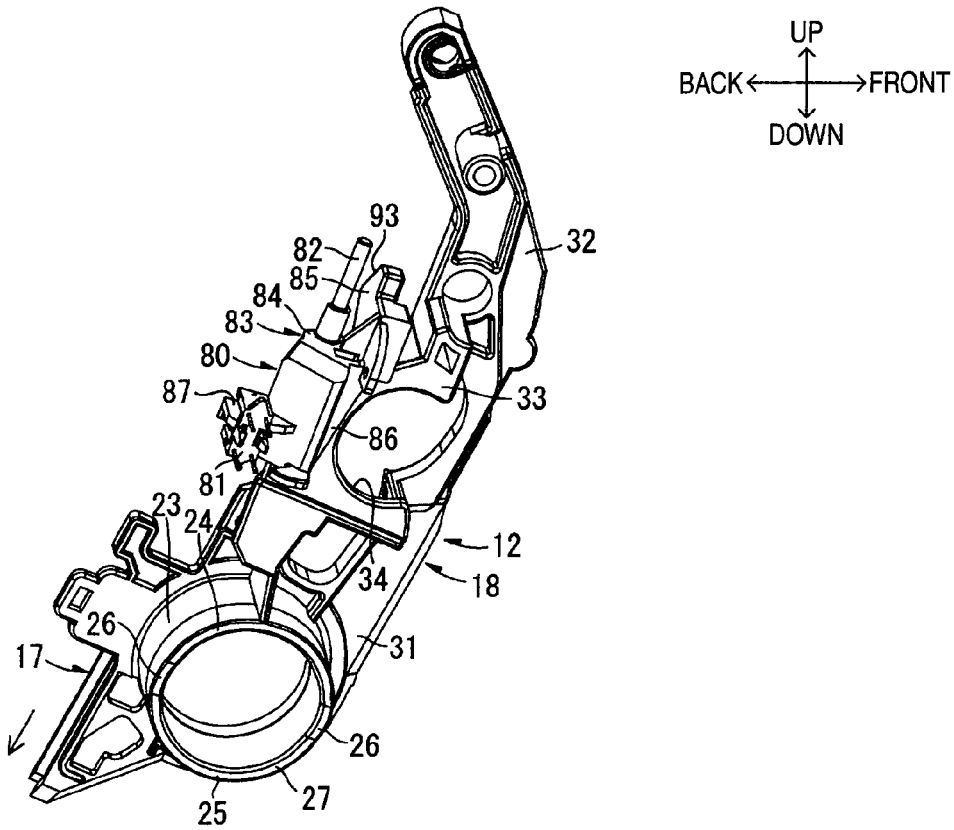
FIG. 9 is a perspective view of a principal section for describing operation for attaching the process cartridge to the main unit casing (a state in which a coupling cover passes by a contact portion)

When the coupling cover 23 of the process cartridge 12 passes by the contact portion 85, the contact portion 85 is swayed toward an upper rear position by restoration force of a coil spring (not shown) while the pivot 82 is taken as a pivot as shown in FIG. 9 so as to advance to a position inside of the attachment and detachment path of the process cartridge 12. The contact portion 85 is thereby arranged again in an ordinary state.

(2) Operation for Detecting Transmission of Information About a Development Cartridge When the top cover 15 is closed (see FIG. 1), the drum-side output coupling 78 (see FIG. 2) and the development-side output coupling 79 (see FIG. 2) advance rightwards in synchronism with opening action of the top cover 15. Specifically, the drum-side output coupling 78 (see FIG. 2) advances rightwards toward the drum-side input coupling 22 and fits into the same. Moreover, the development-side output coupling 79 (see FIG. 2) advances rightwards toward the development-side input coupling 56 and fits into the same by way of the opening 34 of the coupling insertion plate 33.

When the top cover 15 is closed, warm-up operation is commenced under control of the CPU 90, and agitating operation for rotating the agitator 43 is performed.

During agitating operation, a motor provided in the main unit casing 2 is driven under control of the CPU 90, and driving force resultant from rotation is transmitted to the drum-side output coupling 78 and the development-side output coupling 79.

The driving force is then transmitted to the drum-side input coupling 22 into which the drum-side output coupling 78 remains fitted, whereupon the photosensitive drum 3 is rotated. In addition, the driving force is transmitted to the development-side input coupling 56 to which the development-side output coupling 79 remains fitted, whereby the development roller 6, the supply roller 41, and the agitator 43 are rotated.

Specifically, when driving force is transmitted to the development-side input coupling 56, the development-side input coupling 56 is rotated as shown in FIG. 4. The supply roller gear 57 meshed with the development-side input coupling 56 is then rotated, whereby the supply roller 41 is rotated. The first intermediate gear 58 meshed with the development-side input coupling 56 is also rotated, and the development roller gear 59 meshed with the first intermediate gear 58 is rotated. The development roller 6 is subsequently rotated. Moreover, the second intermediate gear 60 meshed with the development-side input coupling 56 is rotated, and the agitator gear 61 meshed with the second intermediate gear 60 is then rotated. Subsequently, the agitator 43 is rotated. Toner in the toner storage chamber 44 is stirred and fluidized by rotating action of the agitator 43.

As the development-side input coupling 56 rotates, its resultant rotational driving force is transmitted to the detection gear 62 meshed with the agitator gear 61, and the detection gear 62 is rotationally driven in a predetermined amount of momentum from commencement of rotational driving operation until stoppage of rotational driving operation.

Specifically, the detection gear 62 is rotated in the direction of an arrow as shown in FIGS. 10A to 10D only in a period during which the agitator gear 61 and the cogged section 67 remain meshed with each other; namely, a distance from an upstream end of the cogged section 67 in its rotating direction until a downstream end of the cogged section in its rotating direction. Namely, the detection gear 62 is associated with the cogged section 67 and comes to a stop after having made about two-thirds of a rotation in one direction. Incidentally, the detection gear 62 is held in its halt state by means of a stopper.

When rotation of the detection gear 62 is commenced, the two projecting portions 70 move in a circumferential direction along the front-back, vertical directions along with rotation of the detection gear 62 as shown in FIG. 10B. First, the projecting portion 7 at a forward position on the detection gear 62 contacts the contact portion 85 remaining in an ordinary state as if it travels from an upper rear position toward a lower front position.

As shown in FIG. 10C, the swaying lever 83 is swayed in the front-back and right-left directions while taking the pivot 82 as a pivot in defiance of restoration force of the coil spring in such a way that the contact portion 85 travels in a lower forward direction and that the arm section 86 travels in an upper rearward direction. The light-shielding plate 87 interposed between the light-emitting element 88 and the light-receiving element 89 of the optical sensor 81 is then moved in a right rearward direction so as to recede from the position between the light-emitting element and the light-receiving element.

When the swaying lever 83 is further swayed, the light-shielding plate 87 recedes from the position between the light-emitting element 88 and the light-receiving element 89 as shown in FIG. 10D, whereupon the detection light intercepted thus far by the light-shielding plate 87 is received by the light-receiving element 89.

Subsequently, when the projecting portion 70 at the forward position is disengaged from the contact portion 85, the swaying lever 83 is swayed by restoration force of the coil spring (not shown) while taking the pivot 82 as a pivot in such a way that the contact portion 85 travels in an upper rearward direction and that the arm section 86 travels in a lower forward direction, whereby the swaying member 80 is restored to an ordinary sate. The detection light is intercepted by the light-shielding plate 87, thereby hindering the light-receiving element 89 from receiving the detection light.

Although unillustrated, rotation of the detection gear 62 is stopped as a result of the projecting portion 70 located at a rearward position on the detection gear 62 additionally contacting the contacting section 85 in the same manner as mentioned above and rotating until the projecting portion is disengaged and the agitator gear 61 and the cogged section 67 being disengaged from each other, to thus cause the agitator gear 61 and the cogless section 68 oppose each other. Warm-up operation including agitating operation thus ends.

Even at this time, the light-shielding plate 87 temporarily recedes from the position between the light-emitting element 88 and the light-receiving element 89, and the light-receiving element 89 temporarily receives the detection light. Subsequently, the detection light is again intercepted by the light-shielding plate 87, thereby hindering the light-receiving element 89 from receiving the detection light.

Information about the development cartridge 14 is thereby transmitted to the main unit casing 2 from the development cartridge 14. Specifically, information about the development cartridge 14 is transmitted from the detection gear 62 to the optical sensor 81 by way of the swaying member 80.

During the agitating operation, the CPU 90 determines, from presence/absence of an input of a received-light signal, whether or not the development cartridge 14 is new, as well as determining, from the number of inputs of a received-light signal, the maximum number of images that the corresponding development cartridge 14 produces.

Specifically, during the agitating operation, the optical sensor 81 transmits to the CPU 90 two received-light signals generated by receipt of the detection light performed twice by the light-receiving element 89.

First, upon detection of the first received-light signal, the CPU 90 determines that the development cartridge 14 is new.

In the CPU 90, the number of input received-light signals is associated so as to correspond to information about the maximum number of images that are generated. Specifically, when the number of input received-light signals is two, the number is associated so as to correspond to information that the maximum number of images that are generated is 6000. Further, the number of input received-light signals is one, the number is associated so as to correspond to information that the maximum number of images that are generated is 3000.

When detected two received-light signals until the end of agitating operation, the CPU 90 determines that the maximum number of images that are produced by the brand-new development cartridge 14 is 6000.

Specifically, in the above exemplification, when the development cartridge 14 is attached, the CPU 90 determines that the development cartridge 14 is brand-new and that the maximum number of images produced by the brand-new development cartridge 14 is 6000. When the number of actually-produced images that has been detected by an unillustrated sheet output sensor since attachment of the development cartridge 14 nearly exceeds 6000, a warning about toner empty is displayed on an unillustrated operation panel.

Even when the process cartridge 12 is temporarily detached for reasons of removal of a jammed sheet P and again attached, the detection gear 62 is held in a standstill by a stopper in such a way that the cogless section 68 opposes the agitator gear 61.

For this reason, even when agitating operation is performed when the process cartridge 12 is again attached, the detection gear 62 is not rotated, and the re-attached development cartridge 14 (an old development cartridge) is prevented from being erroneously determined to be brand-new. Comparison of the maximum number of images to be produced, which is achieved when the development cartridge 14 was determined to be brand-new, with the number of images that have been actually produced on the sheets P since the development cartridge was determined to be brand-new continues.

In the above exemplification, the development cartridge 14 is provided with the detection gear 62 having the two projecting portions 70. However, when the development cartridge 14 is provided with the detection gear 62 having one projecting portion 70, the swaying lever 83 sways once in response to one projecting portion 70. Hence, the CPU 90 detects one received-light signal until the end of agitating operation, thereby determining that the maximum number of images to be produced by the brand-new development cartridge 14 is 3000.

(3) Operation for Detaching the Process Cartridge from the Main Unit Casing

When the development cartridge 14 is replaced after completion of image-generating operation or when a jammed sheet P is removed, the process cartridge 12 is detached from the main unit casing 2.

In order to detach the process cartridge 12 from the main unit casing 2, the top cover 15 is first opened (see FIG. 1). The drum-side output coupling 78 (see FIG. 2) and the development-side output coupling 79 (see FIG. 2) recede leftwards in synchronism with opening of the top cover 15. The drum-side output coupling 78 recedes from the drum-side input coupling 22, whereupon the drum-side output coupling 78 and the drum-side input coupling 22 are released from their fitted state. The development-side output coupling 79 recedes from the development-side input coupling 56 by way of the opening section 34 of the coupling insertion plate 33, whereupon the development-side output coupling 79 and the development-side input coupling 56 are disengaged from their fitted state.

Figure 11:
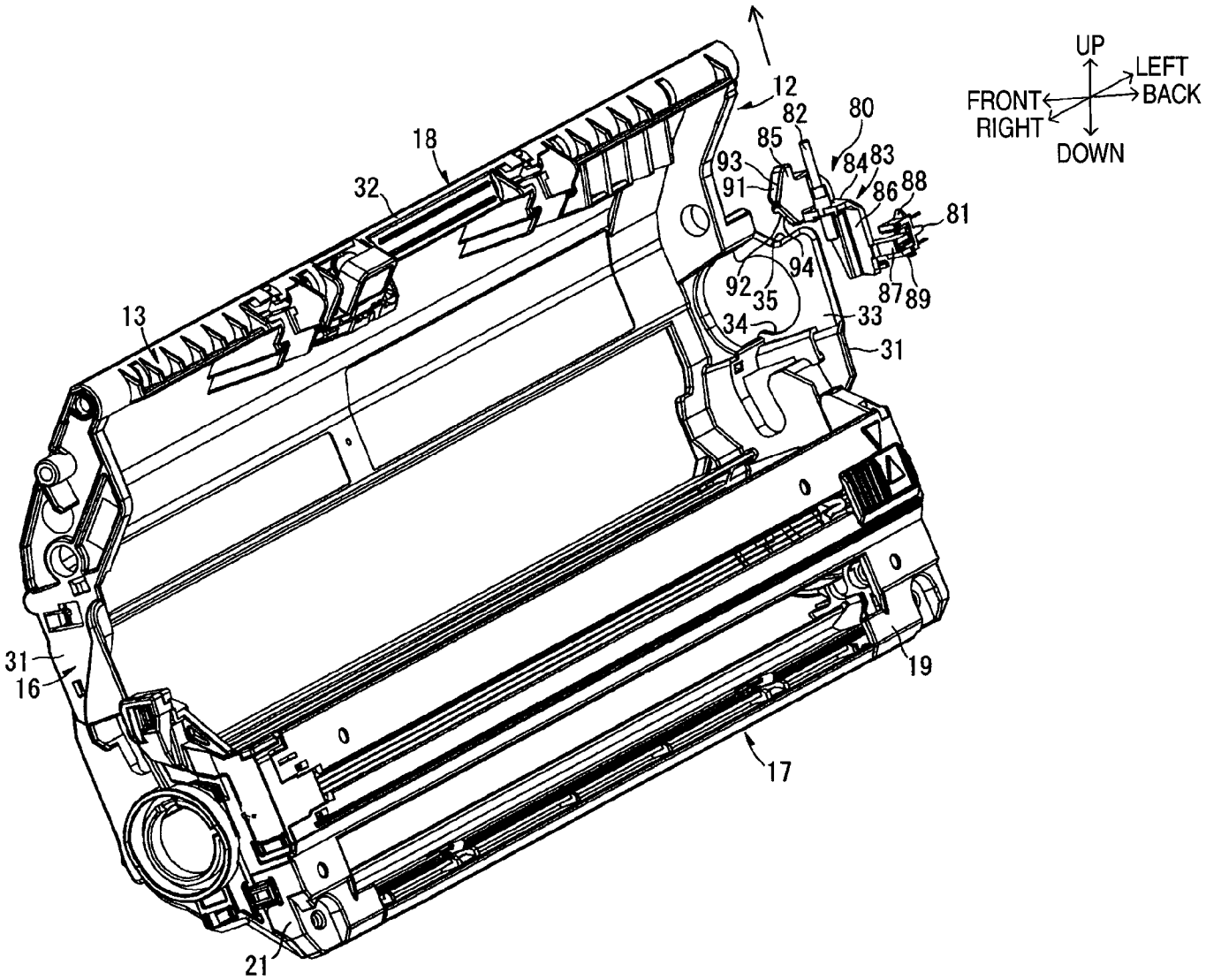
FIG. 11 is a perspective view of a principal section for describing operation for detaching the process cartridge from the main unit casing (a state achieved before the contact portion contacts an upper end face)
Figure 12:
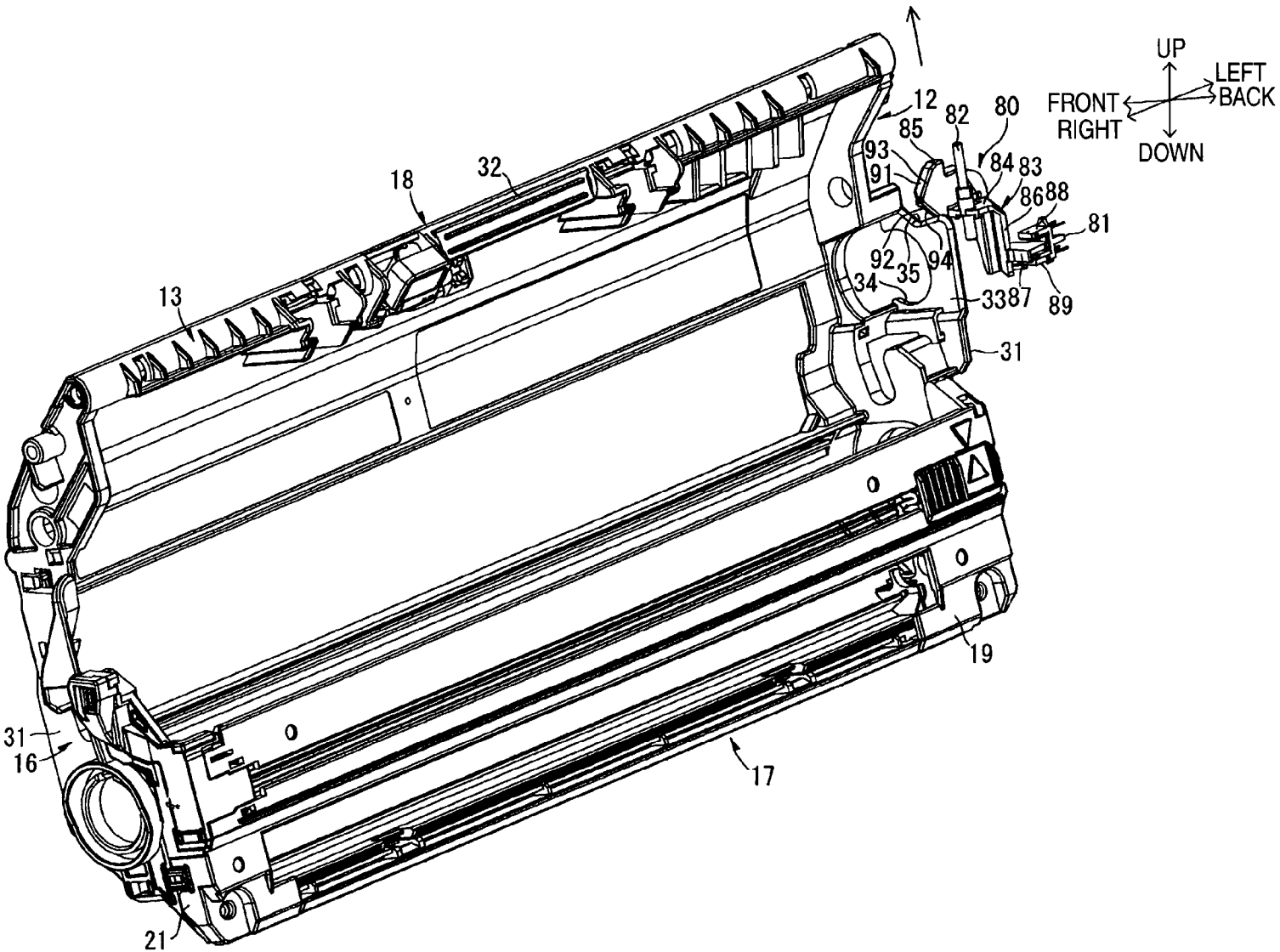
FIG. 12 is a perspective view of a principal section for describing operation for detaching the process cartridge from the main unit casing (a state in which the contact portion contacts an upper end face)
Figure 13:
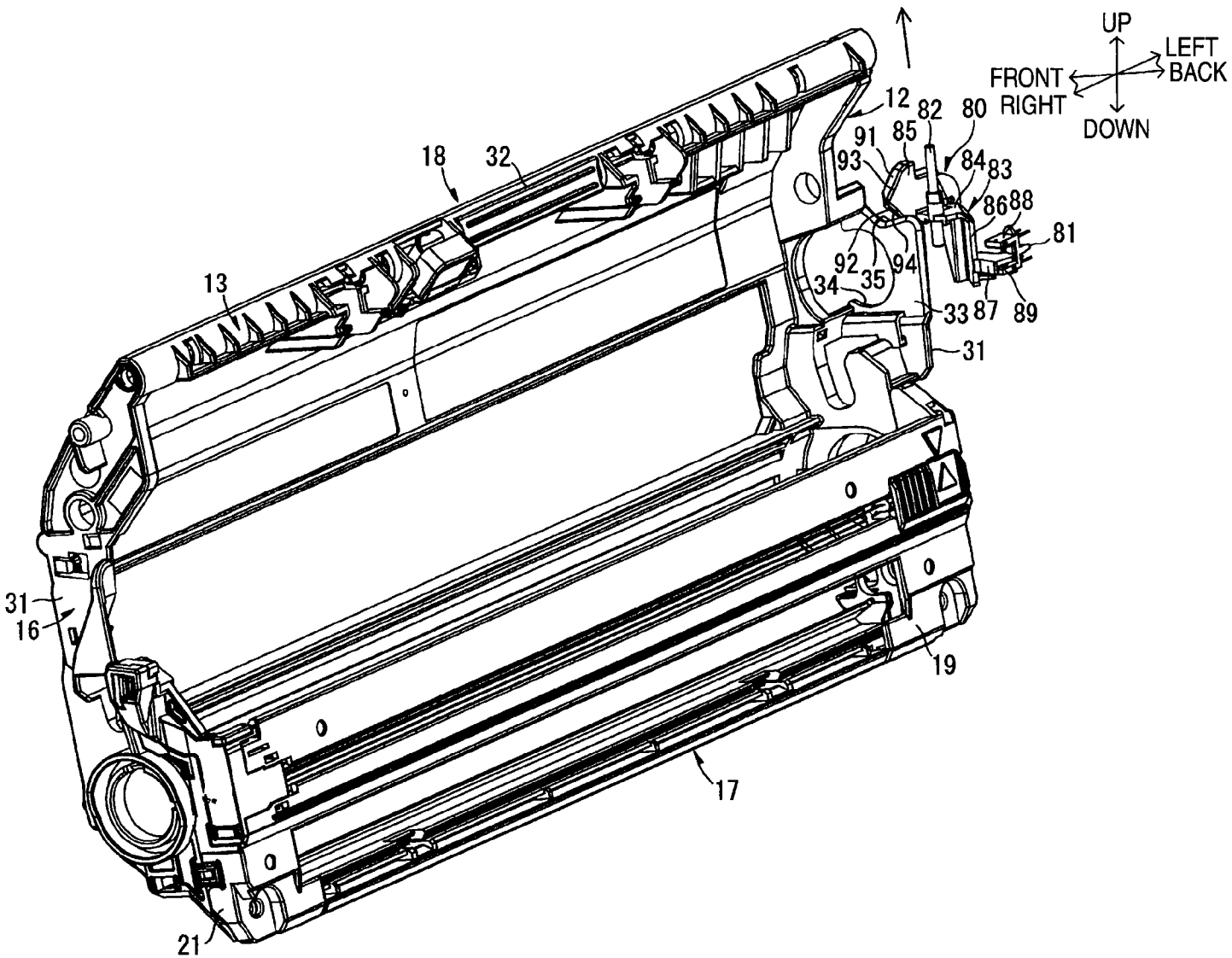
FIG. 13 is a perspective view of a principal section for describing operation for detaching the process cartridge from the main unit casing (a state in which the contact portion contacts an upper end face)
Figure 14:
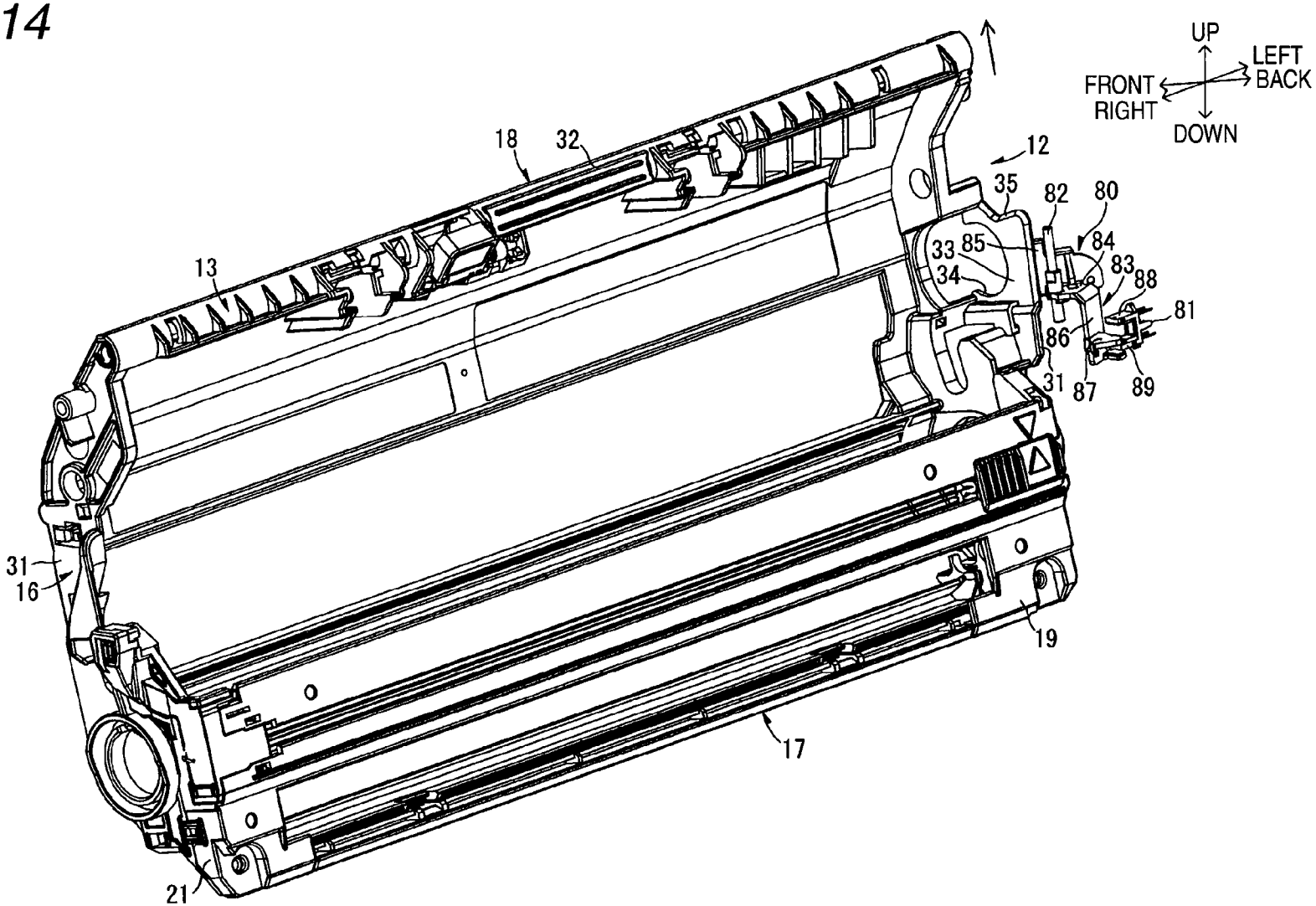
FIG. 14 is a perspective view of a principal section for describing operation for detaching the process cartridge from the main unit casing (a state in which the process cartridge passed by the contact portion).

The process cartridge 12 is detached so as to be withdrawn from the main unit casing 2 along the guide section 77. As shown in FIG. 11, the contact portion 85 is in an ordinary state placed inside of the path of attachment and detachment of the process cartridge 12 to and from the main unit casing 2; hence, the upper edge 35 of the coupling insertion plate 33 in the process cartridge 12 opposes the contact portion 85 in the detachment direction in the middle of detachment of the process cartridge. As shown in FIG. 12, the upper edge 35 eventually contacts the detachment-side contact portion 94 of the contact portion 85. Since the upper edge 35 is inclined from an upper rearward position to a lower forward position, the upper edge 35 performs sliding operation with respect to the detachment-side contact portion 94, as shown in FIG. 13, as the upper edge 35 travels from an upstream position toward a downstream position in the detachment direction, whereupon a position where the upper edge 35 contacts the detachment-side contact portion 94 moves upstream in the detachment direction. The contact portion 85 experiences pressing force resultant from sliding action, to thus be swayed in a lower forward direction so as to recede from the inside of the attachment and detachment path of the process cartridge 12 in defiance of restoration force of the coil spring (not shown) while taking the pivot 82 as a pivot. As a result, the contact portion 85 recedes from the inside of the attachment and detachment path of the process cartridge 12 as shown in FIG. 14, whereby detachment of the process cartridge 12 from the main unit casing 2 is allowed.

Subsequently, when the process cartridge 12 passes by the contact portion 85, the contact portion 85 is swayed in an upper rearward direction by restoration force of the coil spring so as to advance to the inside of the attachment and detachment path of the process cartridge 12 while taking the pivot 82 as a pivot. Thereby, the contact portion 85 is again placed in an ordinary state.

5. Working-Effect of the Embodiment (1) In the printer 1, when the process cartridge 12 is attached to the main unit casing 2, driving force is transmitted from the development-side output coupling 79, whereby the detection gear 62 is rotationally driven in a predetermined amount of momentum. When the detection gear 62 is rotationally driven, the contact portion 85 of the swaying lever 83 contacts the projecting portion 70 of the detection gear 62. Upon contacting the projecting portion 70, the swaying lever 83 is swayed, and the optical sensor 81 detects the swaying action. Information about the development cartridge 14 is thereby transmitted to the main unit casing 2 from the development cartridge 14, and the CPU 90 can determine information about the development cartridge 14 in accordance with a result of detection performed by the optical sensor 81.

In the swaying member 80, the pivot 82 is provided along a direction parallel to the direction of attachment and detachment of the process cartridge. Therefore, even when having contacted the process cartridge 12 at both times of attachment and detachment of the process cartridge, the contact portion 85 can sway, while taking the pivot 82 as the pivot, in a direction in which the contact portion departs from the process cartridge 12. Moreover, when having contacted the process cartridge 12, the contact portion 85 is swayed, while taking the pivot 82 as a fulcrum, in a lower forward direction that is constant at all times. Moreover, even when having contacted the projecting portion 70 of the detection gear 62, the contact portion 85 is swayed in a lower forward direction identical with the foregoing direction.

As a result, the light-shielding plate 87 moves in a single direction at all times; hence, the configuration and layout of the optical sensor 81 in which the light-shielding plate 87 is sandwiched can be made simple. Accordingly, the contacting section 85 can be placed inside of the path for attaching and detaching the process cartridge 12 to and from the main unit casing 2 while the number of components is reduced by means of a simple configuration, so that an attempt can be made to miniaturize the main unit casing 2.

(2) When the detection gear 62 is rotationally driven by the foregoing operation, the projecting portion 70 of the detection gear 62 contacts the contacting section 85 of the swaying lever 83. Therefore, the swaying lever 83 can be swayed without fail, and information about the development cartridge 14 can be reliably transmitted from the development cartridge 14 to the main unit casing 2.

(3) At the time of attachment of the process cartridge 12, the attachment-side contact portion 93 of the contact portion 85 contacts the outer circumference 27 of the coupling cover 23 of the process cartridge 12. The attachment-side contact portion 93 projects toward the process cartridge 12 with an increasing distance from an upstream position toward a downstream position along the attachment direction. Further, the outer circumference 27 is inclined in such a way that the position where the outer circumference contacts the attachment-side contact portion 93 moves upstream in the attachment direction, with an increasing distance from an upstream position toward a downstream position along the attachment direction. Therefore, when the outer circumference and the attachment-side contact portion contact each other, the attachment-side contact portion 93 is swayed in a down forward direction with an increasing distance of the outer circumference 27 from an upstream position toward a downstream position along the attachment direction, so as to move away from the process cartridge 12 along the slope of the outer circumference 27.

At the time of detachment of the process cartridge 12, the detachment-side contact portion 94 of the contact portion 85 contacts the upper edge 35 of the coupling insertion plate 33 in the process cartridge 12. The detachment-side contact portion 94 projects toward the process cartridge 12 with an increasing distance from an upstream position toward a downstream position along the detachment direction. Further, the upper edge 35 is inclined in such a way that the position where the upper edge contacts the detachment-side contact portion 94 moves upstream in the detachment direction, with an increasing distance from an upstream position toward a downstream position along the detachment direction. Therefore, when the upper edge and the detachment-side contact portion contact each other, the detachment-side contact portion 94 is swayed in a direction in which the detachment-side contact portion 94 moves away from the process cartridge 12 along the slope of the upper edge 35 with an increasing distance of the upper edge 35 from an upstream position toward a downstream position along the detachment direction.

Consequently, at both times of attachment and detachment of the process cartridge 12, when contacting the process cartridge 12, the contact portion 85 can be reliably swayed in a single direction by means of a simple configuration while the pivot 82 is taken as a pivot.

(4) Further, in the contact portion 85, the upper front end face 91 projects toward the process cartridge 12 with an increasing distance from an upstream position toward a downstream position along the attachment direction, and the lower rear end face 92 projects toward the process cartridge 12 with an increasing distance from an upstream position toward a downstream position along the detachment direction.

The attachment-side contact portion 93 is defined as a ridge line that determines an upper rear edge of the upper front end face 91, and the detachment-side contact portion 94 is defined as a ridge line that determines an upper rear edge of the lower rear end face 92.

Therefore, at the time of attachment of the process cartridge 12, the attachment-side contact portion 93 can be reliably swayed in a direction in which the attachment-side contact portion 93 moves away from the process cartridge 12 along the slope of the outer circumference 27, as a result of the outer circumference 27 of the coupling cover 23 of the process cartridge 12 contacting the attachment-side contact portion 93 of the contacting section 85.

At the time of detachment of the process cartridge 12, the detachment-side contact portion 94 can be reliably swayed in a direction in which the detachment-side contact portion moves away from the process cartridge 12 along the slope of the upper edge 35, as a result of the upper edge 35 of the coupling insertion plate 33 of the process cartridge 12 contacting the detachment-side contact portion 94 of the contact portion 85.

(5) The contact portion 85 is formed in a triangular shape defined by the upper front end face 91 and the lower rear end face 92. Therefore, the contact portion 85 is readily produced, thereby making it possible to attempt simplify the configuration of the apparatus and curtail its cost.

(6) Moreover, in the contact portion 85, an angle at which the plane extending along the upper front end face 91 crosses the plane extending along the lower rear end face 92 is an obtuse angle. For this reason, at both times of attachment and detachment of the process cartridge 12 to and from the main unit casing 2, when the contact portion 85 contacts the process cartridge 12, the contact portion 85 can be gently and smoothly swayed while the pivot 82 is taken as a pivot.

(7) Further, at the time of attachment of the process cartridge 12, the contact portion 85 contacts the outer circumference 27 of the coupling cover 23. Therefore, at the time of attachment of the process cartridge 12, the coupling cover 23 can prevent the drum-side input coupling 22 from contacting the contact portion 85.

(8) The projecting portion 70 circumferentially moves along the front-back, up-down directions with respect to the circumferential direction of the detection gear 62, whilst the swaying lever 83 is swayed along the front-back, up-down directions while the pivot 82 is taken as a pivot. Since the direction of movement of the projecting portion 70 and the direction of movement of the swaying lever 83 differ from each other, reliable movement of the projecting portion 70 and reliable swaying action of the swaying lever 83 can be assured.

(9) The detection gear 62 has the cogless gear 64. In the period during which driving force is transmitted from the development-side output coupling 79 to the cogged section 67, the detection gear 62 is rotationally driven. In the meantime, when the driving force is not transmitted from the development-side output coupling 79 to the cogless section 68, the rotational driving of the detection gear 62 is stopped. Therefore, the detection gear 62 can be reliably rotated in a predetermined amount of momentum from the initiation of rotational driving until the end of rotational driving.

(10) In the brand-new development cartridge 14, the cogged section 67 of the cogless gear 64 remains meshed with the agitator gear 61. Therefore, the cogless gear 64 is reliably rotated by the driving force from the development-side output coupling 79 by way of the agitator gear 61. For this reason, information about the development cartridge 14 can be reliably transmitted from the development cartridge 14 to the main unit casing 2 by means of reliable rotation of the detection gear 62.

6. Modification (1) In the above description, the contact portion 85 is produced in a triangular shape defined by the upper front end face 91 and the lower rear end face 92. However, the contact portion 85 can also be produced in a quadrangular shape such as a trapezoid shape defined by the upper front end face 91 and the lower rear end face 92.

(2) In the above description, the drum cartridge 13 and the development cartridge 14 are configured as separate elements. However, the drum cartridge 13 and the development cartridge 14 can also be configured integrally as the process cartridge 12.

(3) In the above description, a color LED printer of direct tandem type is exemplified as the printer 1. However, in addition to including the device mentioned above, the image forming apparatus of the present invention includes a color printer of intermediate transfer type, a color laser printer, a monochrome LED printer, a monochrome laser printer, and the like.

As described above, according to a first aspect of the exemplary embodiment, there is provided an image forming apparatus having an apparatus main unit; a cartridge removably attached to the apparatus main unit; a drive transmission member for transmitting driving force to the cartridge; and an information transmission mechanism for transmitting information about the cartridge from the cartridge to the apparatus main unit, wherein the information transmission mechanism includes a drive member that is provided in the cartridge and that performs driving in a predetermined amount of momentum from beginning of driving operation until an end of the same as a result of driving force being transmitted from the drive transmission member when the cartridge is attached to the apparatus main unit, a swaying member that is provided in the apparatus main unit and that sways upon contact with the drive member when the drive member is driven, and a detection member that is provided in the apparatus main unit and that detects swaying action of the swaying member; and the swaying member includes a pivot extending in a direction parallel to a direction of attachment and detachment of the cartridge to and from the apparatus main unit, and a contact portion that contacts the cartridge both at times of attachment and detachment of the cartridge to and from the apparatus main unit, thereby swaying in a single direction while taking the pivot as a fulcrum.

Also, according to a second aspect of the exemplary embodiment, the drive member has a projecting portion that is provided in a projecting manner so as to contact the swaying member when the drive member is driven.

Also, according to a third aspect of the exemplary embodiment, the contact portion has a first contact portion that contacts the cartridge at the time of attachment of the cartridge and a second contact portion that contacts the cartridge at the time of detachment of the cartridge; the first contact portion projects toward the cartridge with an increasing distance from an upstream position toward a downstream position in the attachment direction; the second contact portion projects toward the cartridge with an increasing distance from an upstream position toward a downstream position in the detachment direction; the cartridge has a third contact portion that contacts the first contact portion at the time of attachment of the cartridge and a fourth contact portion that contacts the second contact portion at the time of detachment of the same; the third contact portion is inclined in such a way that a position where the third contact portion contacts the first contact portion moves upstream in the attachment direction with an increasing distance from an upstream position to a downstream position in the attachment direction; and the fourth contact portion is inclined in such a way that a position where the fourth contact portion contacts the second contact portion moves upstream in the detachment direction with an increasing distance from an upstream position to a downstream position in the detachment direction.

Also, according to a fourth aspect of the exemplary embodiment, the contact portion has a first end face that projects toward the cartridge with an increasing distance from an upstream position toward a downstream position in the attachment direction and a second end face that projects toward the cartridge with an increasing distance from an upstream position toward a downstream position in the detachment direction; the first contact portion is provided in an extension of a ridge line that defines the first end face; and the second contact portion is provided in an extension of a ridge line that defines the second end face.

Also, according to a fifth aspect of the exemplary embodiment, the contact portion is formed in a triangular shape or a triangular trapezoid that is defined by the first end face and the second end face.

Also, according to a sixth aspect of the exemplary embodiment, an angle at which a plane extending along the first end face crosses another plane extending along the second end face is an obtuse angle.

Also, according to a seventh aspect of the exemplary embodiment, the cartridge has a photosensitive element that holds a developing-agent image; and the third contact portion is a protective member for a photosensitive element drive member intended for driving the photosensitive element.

Also, according to an eighth aspect of the exemplary embodiment, a direction of movement of the projecting portion differs from a swaying direction of the swaying member.

Also, according to a ninth aspect of the exemplary embodiment, the drive member is equipped with a cogless gear having a cogged section to which driving force is transmitted from the drive transmission member and a cogless section to which driving force is not transmitted from the drive transmission member.

Also, according to a tenth aspect of the exemplary embodiment, the cartridge has a transmission gear to which driving force is transmitted from the drive transmission member when the cartridge is attached to the apparatus main unit; and the cogless gear meshes with the transmission gear.

According to the first aspect of the exemplary embodiment, when the cartridge is attached to the apparatus main unit, driving force is transmitted from the drive transmission member, whereupon the drive member performs driving operation in a predetermined amount of momentum. When the drive member is driven, the swaying member contacts the drive member. The swaying member is swayed upon contact with the drive member, and swaying action is detected by the detection member. Information about the cartridge is thereby transmitted from the cartridge to the apparatus main unit.

In the swaying member, the pivot is provided along a direction parallel to the direction of attachment and detachment of the cartridge to and from the apparatus main unit. Therefore, even when the contact portion contacts the cartridge at both times of attachment and detachment of the cartridge to and from the apparatus main unit, the contact portion can sway, while taking the pivot as a pivot, in a direction in which the contact portion moves away from the cartridge. Moreover, when contacting the cartridge, the contact portion sways in a single direction while taking the pivot as a fulcrum. As a result, the swaying member can be placed inside of the path of attachment and detachment of the cartridge to and from the apparatus main unit by means of a simple configuration while the number of components is reduced, and an attempt can be made to miniaturize the apparatus main unit.

According to the second aspect of the exemplary embodiment, when the drive member is driven, the projecting portion of the drive member contacts the swaying member. Therefore, the swaying member can reliably sway, and information about the cartridge can be transmitted to the apparatus main unit from the cartridge without fail.

According to the third aspect of the exemplary embodiment, when the cartridge is attached to the apparatus main unit, the first contact portion of the contact portion contacts the third contact portion of the cartridge. The first contact portion projects toward the cartridge with an increasing distance from an upstream position toward a downstream position in the attachment direction. The third contact portion is inclined in such a way that a position where the third contact portion contacts the first contact portion moves upstream in the attachment direction with an increasing distance from an upstream position to a downstream position in the attachment direction. Therefore, when the first contact portion contacts the third contact portion, the first contact portion is swayed in a direction in which the first contact portion moves away from the cartridge along the slope of the third contact portion, with an increasing distance of the third contact portion from an upstream position to a downstream position in the attachment direction.

At the time of detachment of the cartridge from the apparatus main unit, the second contact portion of the contact portion contacts the fourth contact portion of the cartridge. The second contact portion projects toward the cartridge with an increasing distance from an upstream position toward a downstream position in the detachment direction. The fourth contact portion is inclined in such a way that a position where the fourth contact portion contacts the second contact portion moves upstream in the detachment direction with an increasing distance from an upstream position to a downstream position in the detachment direction. Therefore, when the second contact portion contacts the fourth contact portion, the second contact portion is swayed in a direction in which the second contact portion moves away from the cartridge along the slope of the fourth contact portion, with an increasing distance of the fourth contact portion from an upstream position to a downstream position in the detachment direction.

As a result, at both times of attachment and detachment of the cartridge to and from the apparatus main unit, upon contact with the cartridge, the contact portion can reliably sway in a single direction by means of a simple configuration while taking the pivot as a fulcrum.

According to the fourth aspect of the exemplary embodiment, a first end face projects toward the cartridge with an increasing distance from an upstream position toward a downstream position in the attachment direction, and a second end face projects toward the cartridge with an increasing distance from an upstream position toward a downstream position in the detachment direction. The first contact portion is provided in an extension of a ridge line that defines the first end face, and the second contact portion is provided in an extension of a ridge line that defines the second end face.

Accordingly, at the time of attachment of the cartridge to the apparatus main unit, the first contact portion can reliably sway in a direction in which the first contact portion moves away from the cartridge along the slope of the third contact portion, as a result of the third contact portion of the cartridge contacting the first contact portion of the contact portion At the time of detachment of the cartridge from the apparatus main unit, the second contact portion can reliably sway in a direction in which the second contact portion moves away from the cartridge along the slope of the fourth contact portion, as a result of the fourth contact portion of the cartridge contacting the second contact portion of the contact portion.

According to the fifth aspect of the exemplary embodiment, the contact portion is formed in a triangular shape or a triangular trapezoid that is defined by the first end face and the second end face. Therefore, the contact portion is readily made, and an attempt can be made to simplify the configuration of the apparatus and curtail cost of the apparatus.

According to the sixth aspect of the exemplary embodiment, an angle at which a plane extending along the first end face crosses another plane extending along the second end face is an obtuse angle. Therefore, at both times of attachment and detachment of the cartridge to and from the apparatus main unit, when contacting the cartridge, the contact portion can be gently, smoothly swayed while the pivot is taken as a pivot.

According to the seventh aspect of the exemplary embodiment, the third contact portion is a protective member for a photosensitive element drive member intended for driving the photosensitive element. Therefore, at the time of attachment of the cartridge to the apparatus main unit, the protective member can prevent the photosensitive element drive member from contacting the contact portion.

According to the eighth aspect of the exemplary embodiment, a direction of movement of the projecting portion differs from a swaying direction of the swaying member; hence, reliable movement of the projecting portion and reliable swaying action of the swaying member can be assured.

According to the ninth aspect of the exemplary embodiment, in the course of driving force being transmitted from the drive transmission member to the cogged section, the drive member rotates. In the meantime, when driving force is not transmitted from the drive transmission member to the cogless section, rotation of the drive member is stopped. Therefore, the drive member can be reliably rotated in a predetermined amount of momentum from the beginning of driving operation until the end of driving operation.

According to the tenth aspect of the exemplary embodiment, the cogless gear meshes with the transmission gear. Hence, the cogless gear is reliably rotated by the driving force from the drive transmission member by way of the transmission gear. Therefore, by virtue of reliable rotation of the drive member, information about the development cartridge can be reliably transmitted from the development cartridge to the apparatus main unit.

What is claimed is:

1. An image forming apparatus comprising:

an apparatus main unit;

a cartridge detachably attached to the apparatus main unit;

a drive transmission member configured to transmit driving force to the cartridge; and an information transmission mechanism configured to transmit information about the cartridge from the cartridge to the apparatus main unit, wherein the information transmission mechanism includes:

a drive member that is provided in the cartridge and that performs driving in a predetermined amount of momentum from beginning of driving operation until an end of the same as a result of driving force being transmitted from the drive transmission member when the cartridge is attached to the apparatus main unit;

a swaying member that is provided in the apparatus main unit and that sways upon contact with the drive member when the drive member is driven; and a detection member that is provided in the apparatus main unit and that detects swaying action of the swaying member, and wherein the swaying member includes:

a pivot extending in a direction parallel to a direction of attachment and detachment of the cartridge to and from the apparatus main unit; and a contact portion that contacts the cartridge both at times of attachment and detachment of the cartridge to and from the apparatus main unit, thereby swaying in a single direction while taking the pivot as a fulcrum.

2. The image forming apparatus according to claim 1, wherein the drive member has a projecting portion that is provided in a projecting manner so as to contact the swaying member when the drive member is driven.

3. The image forming apparatus according to claim 1, wherein the contact portion has a first contact portion that contacts the cartridge at the time of attachment of the cartridge and a second contact portion that contacts the cartridge at the time of detachment of the cartridge, the first contact portion projects toward the cartridge with an increasing distance from an upstream position toward a downstream position in the attachment direction, the second contact portion projects toward the cartridge with an increasing distance from an upstream position toward a downstream position in the detachment direction, and wherein the cartridge has a third contact portion that contacts the first contact portion at the time of attachment of the cartridge and a fourth contact portion that contacts the second contact portion at the time of detachment of the cartridge, the third contact portion is inclined such that a position where the third contact portion contacts the first contact portion moves upstream in the attachment direction with an increasing distance from an upstream position to a downstream position in the attachment direction, and the fourth contact portion is inclined such that a position where the fourth contact portion contacts the second contact portion moves upstream in the detachment direction with an increasing distance from an upstream position to a downstream position in the detachment direction.

4. The image forming apparatus according to claim 3, wherein the contact portion has a first end face that projects toward the cartridge with an increasing distance from an upstream position toward a downstream position in the attachment direction, and a second end face that projects toward the cartridge with an increasing distance from an upstream position toward a downstream position in the detachment direction, and wherein the first contact portion is provided in an extension of a ridge line that defines the first end face, and the second contact portion is provided in an extension of a ridge line that defines the second end face.

5. The image forming apparatus according to claim 4, wherein the contact portion is formed in a triangular shape or a trapezoid shape that is defined by the first end face and the second end face.

6. The image forming apparatus according to claim 4, wherein an angle at which a plane extending along the first end face crosses another plane extending along the second end face is an obtuse angle.

7. The image forming apparatus according to claim 3, wherein the cartridge has a photosensitive element that holds a developing agent image, and the third contact portion is a protective member that is configured to protect a photosensitive element drive member for driving the photosensitive element.

8. The image forming apparatus according to claim 2, wherein a direction of movement of the projecting portion differs from a swaying direction of the swaying member.

9. The image forming apparatus according to claim 1, wherein the drive member comprise a cogless gear that has a cogged section to which driving force is transmitted from the drive transmission member and a cogless section to which driving force is not transmitted from the drive transmission member.

10. The image forming apparatus according to claim 9, wherein the cartridge has a transmission gear to which driving force is transmitted from the drive transmission member when the cartridge is attached to the apparatus main unit, and the cogless gear meshes with the transmission gear.

* * * * *